US006526953B1

(12) United States Patent
Inagaki

(10) Patent No.: US 6,526,953 B1
(45) Date of Patent: Mar. 4, 2003

(54) IGNITION UNIT FOR INTERNAL COMBUSTION ENGINE

(75) Inventor: Hiroshi Inagaki, Komaki (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 09/603,653

(22) Filed: Jun. 26, 2000

(30) Foreign Application Priority Data

Jun. 25, 1999 (JP) ..... 11-180575
Apr. 26, 2000 (JP) ..... 2000-126059

(51) Int. Cl.[7] ..... F02P 23/04; F02P 9/00
(52) U.S. Cl. ..... 123/609; 123/618; 123/652
(58) Field of Search ..... 123/527, 625, 123/626, 645, 646, 651, 652, 618, 609

(56) References Cited

U.S. PATENT DOCUMENTS 4,406,273 A 9/1983 Yoshinaga et al.
5,220,903 A * 6/1993 Niemetz ..... 123/651
5,814,994 A 9/1998 Hohner et al.
5,947,090 A * 9/1999 Maeda ..... 123/490
5,970,965 A 10/1999 Bentel et al.

FOREIGN PATENT DOCUMENTS

DE 196 49 278 A1 6/1998
EP 0 848 161 A2 6/1998
JP 60-56910 12/1985 ..... F02P/3/00
JP 10-184521 7/1998 ..... F02P/17/12

OTHER PUBLICATIONS

English language abstract JP 58204971 Nov. 29, 1983.
English language abstract JP 10184521 A Jul. 14, 1998.

* cited by examiner

*Primary Examiner*—Tony M. Argenbright
*Assistant Examiner*—Johnny H. Hoang
(74) *Attorney, Agent, or Firm*—Sughrue Mion, PLLC

(57) ABSTRACT

For minimizing spark energy and improving durability of a spark plug (13) without controlling a time for energizing a primary wiring (L1); the ignition unit (1,2 and 3) for an internal combustion engine is arranged in that actions of a transistor (17) are controlled by an ECU (19) to abruptly interrupt a primary current (i1) such that high voltage for ignition induced to a secondary wiring (L2) is applied on the spark plug (13) for generating spark discharge. For forcibly interrupting spark discharge at a spark discharge duration, the ECU (19) switches the thyristor (21 and 210) ON to supply current to the primary wiring (L1) for forcibly interrupting the spark discharge. By controlling the spark discharge duration to be optimum on a basis of an operating condition of the internal combustion engine, it is possible to restrict generation of multiple discharge and to restrict exhaustion of electrodes of the spark plug (13). It is also possible to realize spark discharge through a simple arrangement of low cost by simply providing a single thyristor (21 and 210).

7 Claims, 10 Drawing Sheets

HORIZONTAL AXIS

TIME (0.5 mSec/DIV)

VERTICAL AXIS

1: IG SIGNAL (5V/DIV)
2: THYRISTOR GATE SIGNAL (5V/DIV)
3: PRIMARY CURRENT (2A/DIV)
4: SECONDARY VOLTAGE (1kV/DIV)

HORIZONTAL AXIS

TIME (0.5 mSec/DIV)

VERTICAL AXIS

1: IG SIGNAL (5V/DIV)
2: THYRISTOR GATE SIGNAL (5V/DIV)
3: PRIMARY CURRENT (2A/DIV)
4: SECONDARY VOLTAGE (1kV/DIV)

IGNITION UNIT FOR INTERNAL COMBUSTION ENGINE

BACKGROUND OF THE INVENTION

The present invention relates to an ignition unit for an internal combustion engine for applying high voltage for ignition onto a spark plug and causing the spark plug to perform a spark discharge.

It is known that an amount of spark energy required for obtaining a normal combustion of mixed gas within an internal combustion engine is dependent on operating conditions of the internal combustion engine. The spark energy can be expressed by an amount of discharge current (secondary current) that is made to flow through spark discharge and by duration of spark discharge.

When the engine is in a low-revolution and low-load condition at the time of idling driving or the like, combustion of mixed gas is progressed in at a very sluggish speed due to a small loading amount of mixed gas to a combustion chamber and a slow flow velocity of turbulent flow (swirl flow or tumble flow) of mixed gas. For achieving stable combustion in such a low-revolution and low-load condition, it is thus necessary to increase the spark energy for supporting growth of a flame core to thereby support combustion of mixed gas. On the other hand, in a high-revolution and high-load condition, combustion is progressed at a high speed owing to a large loading amount of mixed gas to the combustion chamber and a high density of mixed gas so that a relatively small spark energy suffices.

A conventional ignition unit for an internal combustion engine was therefore arranged to be capable of supplying maximum spark energy required for various operating conditions of the internal combustion engine so as to prevent shortage of spark energy.

However, the supply of spark energy will be excess when the conventional internal combustion engine may be operated with smaller spark energy than the maximum required spark energy. This excess supply of spark energy will neither contribute to ignition of the mixed gas nor will it cause an excess increase in electrode temperature of the spark plug to thereby lead to faster exhaustion of the electrodes.

It is another drawback that the flow velocity of turbulent flow of the mixed gas becomes stronger (faster) the more the internal combustion engine approaches its high-rotation and high-load operating condition to cause repeated phenomena (so-called multiple discharge) wherein sparks are flown to a downstream side in the latter half of spark discharge in which the spark energy is decreasing until the spark discharge is finally blown off and repeatedly generated. In the presence of such phenomena, fusing or spattering of electrode materials of the spark plug is promoted owing to aggregation of sparks on the downstream side and owing to abrupt increases in electrode temperature to cause so-called irregular exhaustion with downstream side electrodes being particularly exhausted and the life of the spark plug is shortened in vain.

On the other hand, a so-called full-transistor type ignition unit is becoming common in these years for use as an ignition unit for an internal combustion unit that employs a switching element comprised of a semiconductor element such as a power transistor or the like as a means for switching between an energized/deenergized (interrupted) condition of a primary winding of the ignition coil for applying high voltage for ignition on the spark plug. In such an ignition unit of full-transistor type, time for energizing the primary coil of the ignition coil can be easily controlled by adjusting a time for driving the switching element (ON time). It is therefore possible in such a type of ignition unit for an internal combustion engine to control the spark energy to be of an amount required for combustion of mixed gas by controlling the time for energizing the primary wiring of the ignition coil in accordance with operating conditions of the internal combustion engine.

However, in performing control of the time for energizing the primary winding through the ignition coil before generation of spark discharge through the spark plug, an amount of energy stored in the ignition coil through the energizing will become small when the time for energizing is short, and the high voltage for ignition generated in a second wiring by interrupting energizing will accordingly become small. Consequently, when the time for energizing the primary wiring is set to be short for the purpose of, for instance, reducing the amount of spark energy at the time the internal combustion engine is in a high-rotation and high-load condition, the high voltage for ignition generated in the second wiring by energizing/deenergizing the first wiring of the ignition coil will become small so that it is impossible to obtain a high voltage for ignition suitable for a high-rotation and high-load operating condition wherein voltage required for ignition of the spark plug is high and may lead to misfire.

SUMMARY OF THE INVENTION

It is an object of the present invention to provide an ignition unit for an internal combustion engine wherein spark energy is minimized without controlling time of energizing a primary wiring of an ignition coil prior to generation of spark discharge, and to achieve long-life of a spark plug by restricting multiple discharge that is apt to be generated under a high-rotation and high-load operating condition.

According to one aspect of the present invention, the ignition unit for an internal combustion engine comprises an ignition coil including a primary wiring connected to a power source unit and a second wiring forming a closed loop together with a spark plug equipped in the internal combustion engine; a spark discharge generating means for energizing current from the power source unit to the primary wiring of the ignition coil synchronously with the rotation of the internal combustion engine and for generating high voltage for ignition in the second wiring by interrupting the energizing current to thereby make the spark plug perform spark discharge; a primary wiring short-circuiting means for short-circuiting both ends of the primary wiring of the ignition coil in correspondence to instructions from an instruction means; a spark discharge duration calculating means for calculating a spark discharge duration required for combusting mixed gas through spark discharge of the spark plug based on an operating condition of the internal combustion engine; and a spark discharge interrupting means for forcibly interrupting spark discharge of the spark plug by short-circuiting both ends of the primary wiring of the ignition coil by actuating the primary wiring short-circuiting means in accordance with the spark discharge duration calculated by the spark discharge duration calculating means.

By short-circuiting both ends of the primary wiring through the primary wiring short-circuiting means when spark discharge is being generated, current starts to flow through a closed loop formed by the primary wiring and the primary wiring short-circuiting means through a magnetic flux remaining in the ignition coil. This current being gradually increased and voltage which is of opposite polarity to that of the high voltage for ignition that had been generated in the secondary wiring when spark was generated, being induced on the secondary wiring, through magnetic flux remaining in the iron core of the ignition coil, spark discharge at the spark plug is forcibly interrupted or extinguished.

Spark discharge will not be immediately interrupted upon short-circuiting both ends of the primary wiring, but the spark discharge is only interrupted when a primary current has increased to a level for inverting the polarity of induced voltage generated in the secondary wiring after short-circuiting both ends of the primary wiring. It is therefore necessary to perform short-circuiting of both ends of the primary wiring through the switching element prior to an interrupting timing for the spark discharge, wherein the time between short-circuiting both ends of the primary wiring and interrupting the spark discharge becomes longer the more magnetic flux is remaining in the ignition coil and shorter the less magnetic flux is remaining. However, since the amount of magnetic flux remaining in the ignition coil is determined by the spark discharge duration, it will be possible to perform interruption of spark discharge at a proper timing by setting the timing for short-circuiting both ends of the primary wiring in accordance with the spark discharge duration.

In other words, the present invention does not perform control time for energizing the primary wiring prior to the spark discharge generation based on the operating condition of the internal combusting engine for limiting excess supply of spark energy, but controls the spark discharge duration by forcible interrupting spark discharge so that it is enabled to set the time for energizing the primary wiring prior to the generation of spark discharge to be sufficiently longer. Accordingly, high voltage for ignition generated in the second wiring can be applied to the spark plug by an amount that is large enough for performing reliable ignition in various operational conditions of the internal combustion engine, and occurrence of misfire can be limited.

By arranging the spark discharge duration to be calculated based on the operating condition of the internal combustion engine, excess supply of spark energy can be limited by calculating the spark discharge duration to be short in an operating condition requiring only a small amount of spark energy (e.g. when performing high-rotation and high-load). On the other hand, it is enabled to reliably combust mixed gas by calculating the spark discharge duration to be long in an operating condition in which mixing gas is hard to be ignited, for instance, when the internal combustion engine in a low-rotation and low-load condition.

Further, by setting the spark discharge duration to be short in a high-rotation and high-load condition in the above-described manner, it is possible to effectively limit generation of multiple discharge in a condition in which turbulent flow of mixed gas is strong, such as in the high-rotation and high-load condition. In other words, the spark discharge duration is set to be short in a high-rotation and high-load operating condition since ignition properties to the mixed gas are favorable and ignition can be performed also with small spark energy, while spark discharge is interrupted prior to the generation of multiple discharge that is apt to be generated in the latter half of spark discharge to thereby limit multiple discharge.

The present invention is particularly effective when being applied to an internal combustion engine such as a lean-burn engine performing combustion at an air-fuel ratio of not less than 20. In general, the flow velocity of turbulent flow of mixed gas is made strong in an internal combustion engine performing combustion at a lean airfuel ratio because it is impossible to achieve stable ignition properties unless the lean fuel is made to be a uniformly dispersed mixed gas before spark discharge is started. This leads to the fact that multiple discharge is apt to occur in the latter half of spark discharge in which the spark energy is degraded and exhaustion of electrodes (irregular exhaustion) of the spark plug is apt to be promoted. On the other hand, the ignition properties to the mixed gas will be favorable even when the spark energy is small when the internal combustion engine is in the high-rotation and high-load operating condition even though this engine be one combusting at lean air-fuel rates. Thus, by employing the ignition unit for an internal combustion engine of the present invention for reducing the spark discharge duration in the high-rotation and high-load condition and interrupting spark discharge prior to the generation of multiple discharge that is apt to be generated in the latter half of spark discharge, it is possible to secure favorable ignition properties while limiting generation of multiple discharge.

For forcibly interrupting spark discharge, it is possible to employ an arrangement wherein current is made again to flow through the primary wiring by using the external power source through which current was applied on the primary wiring for generating spark discharge and the switching means. According to this style, the time between short-circuiting of the switching means and interruption of the spark discharge can be decreased since current is forcibly applied to the primary wiring through the external power source, and it is possible to set the spark discharge duration to be even shorter. However, since current is supplied by the external power source, the amount of current energized to the primary wiring tends to be large and a heating value of a semiconductor element will accordingly become larger when using the semiconductor element as the switching means. It will thus be necessary to employ an expensive semiconductor element that exhibits superior durability to stand heat, and thus leads to a problem of increased costs. While it is further possible to provide a plurality of semiconductor elements of low cost to restrict heating values of these semiconductor elements by dispersing the energized current, such a measure will lead to increases in the number of parts to make the controlling process complicated.

In contrast thereto, since the ignition unit for an internal combustion engine according to the present invention is not arranged to interrupt sparks through re-energizing from an external power source, it is possible to make the amount of current to be energized to the primary wiring small at the time of interrupting sparks, and it is not necessary to employ an expensive semiconductor element of superior durability when using a semiconductor element as the primary wiring short-circuiting means. Further, since the primary wiring short-circuiting means merely needs to perform short-circuiting of both ends of the primary wiring, the means may be realized, for instance, by using a single switching element to thereby simplify controlling processes.

It is therefore enabled by the present invention to realize an ignition unit for an internal combustion engine for performing interruption of sparks as a simple arrangement employing a small number of parts and using parts made of low-cost materials.

On the other hand, since the primary wiring short-circuiting means merely needs to perform short-circuiting of both ends of the primary wiring as described above, it is also possible to employ a mechanical relay switch or similar besides a semiconductor switching element such as a transistor or a bi-directional three-terminal thyristor. However, due to the fear that spark discharge might be repeatedly generated upon abruptly interrupting the primary current when both ends of the primary wiring are released before the magnetic flux remaining in the ignition coil is completely consumed, it is necessary to keep on short-circuiting both ends of the primary wiring until no current is flown in the primary wiring. In addition thereto, since the amount of magnetic flux remaining in the ignition coil is dependent on the spark discharge duration as explained above, the timing for releasing both ends of the primary wiring needs to be set based on the spark discharge duration.

It is therefore preferable to arrange the primary wiring short-circuiting means by a switching element permitting energizing only in a direction for consuming the magnetic flux stored in the ignition coil in accordance with instructions from an instruction means for short-circuiting both ends of the primary wiring of the ignition coil, and releasing both ends of the primary wring thereafter in the absence of current flowing in the permitted direction.

In other words, after the primary wiring short-circuiting means starts short-circuiting of the primary wiring upon receipt of instructions from an instruction means, current is terminated from flowing in the primary wiring irrespective of the instructions so that both ends of the primary wiring are automatically released. It can thereby be eliminated for the necessity of performing controlling processes for setting a timing for releasing the primary wiring based on the spark discharge duration and performing controlling processes for releasing the primary wiring short-circuiting means whereby controlling processes of the primary wiring short-circuiting means can be simplified.

Moreover, since voltage is applied to make current flow in a direction opposite to the permitted direction also in case energizing of the primary wiring is started prior to the spark discharge without complete consumption of magnetic flux remaining in the ignition coil, the primary wiring short-circuiting means will release both ends of the primary wiring. It can therefore be prevented that both ends of the primary wiring are erroneously short-circuited by the primary wiring short-circuiting means at the time of energizing the primary wiring prior to the spark discharge to thereby interfere storage of spark energy by the ignition coil.

It should be noted that methods for short-circuiting both ends of the primary wiring may be, for instance, a method for short-circuiting both ends of the primary wiring in a circuit comprised by a pup transistor (Tr1) and a npn transistor (Tr2) or a method for short-circuiting both ends of the primary wiring by means of a thyristor with an external instruction signal being input to a gate thereof.

For instance, when short-circuiting both ends of the primary wiring in a circuit comprised of transistors, a circuit shall be employed that is arranged by connecting a base of Tr1 to a collector of Tr2 and a collector of Tr1 to a base of Tr2, wherein the emitters of Tr1 and Tr2 are respectively connected to the primary wiring. This circuit is further arranged in that when the external instruction signal input to the base of Tr2 is of high level, Tr2 will be in an ON condition while Tr1 will be in an ON condition as well through base current flowing to Tr1. Since base current will accordingly be supplied further to Tr2 through the collector of Tr1, Tr1 and Tr2 will maintain their ON conditions as long as base current is supplied to Tr2 even though the external instruction signal is changed to low level to thereby make the primary current flow through the primary wiring. Thereafter, when the primary current becomes small and Tr2 comes to an OFF condition, Tr1 will accordingly come to an OFF condition to release both ends of the primary wiring. With this arrangement, it can be eliminated for the necessity of setting timings for releasing both ends of the primary wiring and performing controlling processes for releasing the primary wiring short-circuiting means. It should be noted that current is made to flow to the primary wiring by permitting energizing only in a direction in which current is flown in from the emitter of Tr1 and flown out from the emitter of Tr2.

For short-circuiting both ends of the primary wiring by using a thyristor, the thyristor shall be connected in a parallel manner to the primary wiring as illustrated in the embodiment to be described later. According to the circuit of the embodiment to be described later, energizing is permitted only in a direction for energizing the thyristor when the external instruction signal input to the gate comes to a high level and the thyristor is switched to an ON condition so that both ends of the primary wiring are short-circuited for making the primary current flow. The ON condition of the thyristor is continued unless the primary current is kept on being energized even though the external instruction signal that is input to the gate comes to a low level. When no primary current is energized anymore, the thyristor comes to an OFF condition to release both ends of the primary wiring. Such a method employing a thyristor may be arranged by using a single semiconductor element (thyristor) and does not require utilization of a plurality of semiconductor elements like a circuit arranged of a transistor, and it is possible to advantageously realize the circuit through a simple arrangement of low cost.

Therefore, by employing the above-described arrangement, it is possible to simplify controlling processes for spark interruption and to prevent malfunctions interfering storage of spark energy by the ignition coil, and it is possible to realize an ignition unit for an internal combustion engine of low cost and of high reliability.

It is a second noteworthy point of the present invention that a gate terminal of the switching element is further connected to a driving signal output means for outputting a driving signal of a higher potential than a potential of a positive terminal of the power source unit upon receipt of an instruction signal output from the spark discharge interrupting means in accordance with the spark discharge duration.

For driving the switching element that is connected in a parallel manner to both ends of the above-described primary wiring, it is necessary to input a specified amount of current to the gate terminal sufficient for driving the switching element and to input a signal to the gate terminal that is of a higher potential than a potential of a cathode terminal that is connected to the positive terminal of the power source unit. For inputting a driving signal to the gate terminal of the switching element of a higher potential than the potential of the positive terminal of the power source unit, it may be possible to incorporate, for instance, a step-up unit (DC/DC converter etc.) for outputting the above driving signals within an engine control unit (so-called ECU) for comprehensively controlling the internal combustion engine including signal control (ignition control) for energizing/deenergizing a main control switching means. However, in realizing the ignition unit for an internal combustion engine of the present invention by modifying a conventionally used engine control unit, the number of items of which arrangements are to be on the engine control unit side (modifying items) will be increased. Moreover, when making the engine control unit incorporate the step-up unit such as a DC/DC converter or the like, a step-up transformer that is generally provided in a step-up circuit will become a noise source to induce malfunctions in a microcomputer or the like comprising the engine control unit, such that the control of the internal combustion engine through the engine control unit may become unstable.

However, according to the other aspect of the present invention, it is not necessary to provide a step-up unit on the engine control unit side since the driving signal output means is arranged to output a driving signal, which is of higher potential than the potential of a positive terminal of the power source unit, to the gate terminal of the switching element upon receipt of an instruction signal corresponding to the spark discharge duration. In other words, the switching element is driven by using an arrangement for outputting a potential to the gate terminal of the switching element, that is higher than that of the positive terminal (cathode terminal) of the power source unit for short-circuiting both ends of the primary wiring, the arrangement being comprised by the driving signal output means provided separate from the engine control unit and at the ignition unit itself. Consequently, control of the internal combustion engine through the engine control unit will not become instable also when driving the switching element.

The driving signal output means for outputting a driving signal, which is of higher potential than the potential of a positive terminal of the power source unit, to the gate terminal of the switching element may be preferably comprised of a capacitor which one terminal (hereinafter referred to as "first terminal") is connected to the gate terminal of the switching element and a charge/discharge control means connected to the other terminal of the capacitor (hereinafter referred to as "second terminal") for controlling charge/discharge of the capacitor. A driving signal of higher potential than the potential of the positive terminal of the power source unit is output to the gate terminal of the switching element by the action of the charge/discharge control means for charging the capacitor by setting the potential of the second terminal of the capacitor to a potential of the negative terminal side of the power source unit while the capacitor is discharged such that the potential of the first terminal comes to a higher potential than the potential of the positive terminal of the power source unit based on an instruction signal.

More particularly, the charge/discharge control means sets the potential of the second terminal of the capacitor to the potential of the negative terminal side of the power source based on an instruction signal from the spark discharge interrupting means to thereby charge the capacitor through power source supply from the power source unit. In this manner, the capacitor will be charged until a voltage thereof becomes equal to the power source voltage of the power source unit. At this time, the capacitor is charged such that the first terminal becomes a high potential and the second terminal a low potential. The charge/discharge control means then makes the capacitor discharge by setting the potential of the second terminal to a potential of the positive terminal side of the power source unit (such that the potential of the first terminal becomes a higher potential than the potential of the positive terminal of the power-source unit) based on an instruction signal from the spark discharge interrupting means. At this time, the potential of the second terminal of the capacitor will become substantially equal to the potential of the positive terminal of the power source unit the moment discharge of the capacitor is started, and the potential of the first terminal will become a potential corresponding to the potential of the power source unit increment by the voltage of the capacitor at the time of charge. Thus, when discharge is started by the capacitor, the potential of the first terminal will at least be a higher potential than the potential of the positive terminal of the power source while discharge current of the capacitor is made to flow into the gate terminal of the switching element so that the switching element is driven.

Therefore, according to the above arrangement, it is possible to arrange a driving signal output means capable of driving a switching element that is connected in a parallel manner to both ends of the primary wiring without providing an expensive step-up unit, and to provide an ignition unit for an internal combustion engine of reduced costs.

It is preferable that a current restricting means for restricting an amount of discharge current when the capacitor performs discharge be serially connected to the capacitor. By the provision of the current restricting means, the amount of discharge current flowing from the capacitor to the gate terminal of the switching means can be restricted when discharge of the capacitor is performed through the charge/discharge control means. It can thus be prevented that excess discharge current (rush current) be flown into the gate terminal of the switching element when forcibly interrupting spark discharge and to effectively prevent damages of the switching element.

It is further preferable that a noise eliminating means be provided between a connecting point of the gate terminal of the switching element and the first terminal of the capacitor and the power source unit for preventing entrance of noise to the gate terminal of the switching element.

By the provision of the noise eliminating means, the switching element will not come to a short-circuited condition at an improper timing, and it is thus possible to prevent abnormal generation of spark discharge and an improper interrupting timing for spark discharge. Accordingly, the internal combustion engine can be stably operated even when employing an arrangement wherein the switching element, which is connected to both ends of the primary wiring in a parallel manner, is driven by using the driving signal output means comprising the above-described capacitor and the charge/discharge control means.

The ignition unit for an internal combustion engine of the present invention works better when being employed with a gas engine using a gaseous fuel as fuel.

Since gaseous fuel exhibits higher insulating properties in contrast to gasoline which is a liquid fuel, the spark discharge voltage will be relatively higher. It is therefore necessary to set a maximum secondary voltage generating performance for the ignition coil suitable for use with a gas engine using a gaseous fuel to be higher than that of one used with a gasoline engine (for instance, when the maximum secondary voltage of the ignition coil suitable for use with a gasoline engine is not less than 30 kV, that of a ignition coil suitable for use with an gas engine is set to be not less than 40 kV). It is thus required to design the ignition coil to increase a primary/secondary turns ratio as well as a wiring number of the primary wiring and the second wiring or to increase the primary current value for performing interruption.

However, while the maximum secondary voltage generating performance can be increased employing the above-described design for the ignition coil, it will simultaneously cause a drawback of increasing the spark energy. This is due to influences of a reciprocal relationship between the spark discharge duration and a maximum secondary current wherein a peak value of the secondary current increases when designing the spark discharge duration to be short (designing the ignition coil to decrease the primary/secondary turns ratio) so that exhaustion of the electrode of the spark plug is promoted through increase in energy density. Further, when designing the secondary current value to be small (designing the ignition coil to increase the primary/secondary turns ratio), it is possible to decrease the peak value of the secondary current while increasing the spark discharge duration instead which, in turn, affects the exhaustion of the electrode of the spark plug. In other words, the amount of unnecessary supply of spark energy to the spark plug is considered to be larger when using a gas engine rather than a gasoline engine so as to further shorten the life of the spark plug.

Therefore, by applying the ignition unit for an internal combustion engine of the present invention to the above-described gas engine using gaseous fuel, it is possible to effectively prevent excess supply of spark energy and further to improve the maximum secondary voltage (high voltage for ignition) generating performance, and thus to work best for exhibiting the effect of achieving a long life of the spark plug.

The ignition unit for an internal combustion engine of the present invention becomes effective when being applied particularly to a stationary gas engine among gas engines. Since fuel economy is an important factor in view of performance of a stationary gas engine, leaning is promoted for achieving sparing of fuel. It is therefore necessary for the stationary gas engine to make the flow velocity of turbulent flow of mixed gas stronger for effectively combusting at a lean air-fuel ratio so that multiple discharge tends to be generated between electrodes of the spark plug. Thus, by applying the ignition unit for an internal combustion engine of the present invention to a stationary gas engine, it is enabled to restrict generation of multiple discharge and to restrict exhaustion of electrodes (irregular exhaustion) of the spark plug.

BRIEF EXPLANATIONS OF THE DRAWINGS

The embodiments of the present invention will now be explained together with the drawings, wherein.

EXPLANATIONS OF THE PREFERRED EMBODIMENTS

First Embodiment

Explanations of embodiments will now be made for an internal combustion engine of single cylinder type, while the present invention may also be applied to an internal combustion engine comprising a plurality of cylinders with principle arrangements of ignition units for each cylinder being identical.

Figure 1:
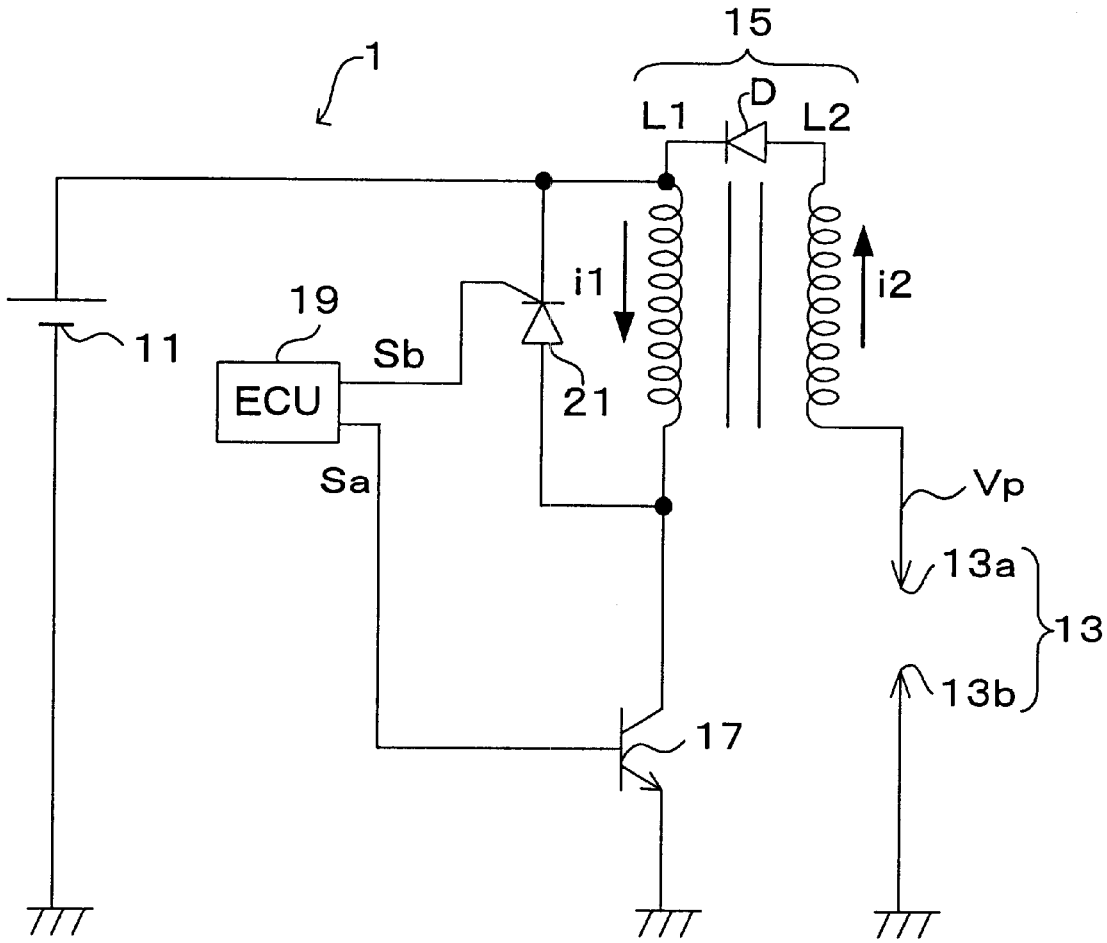
FIG. 1 is an electric circuitry view representing an arrangement of the ignition unit for an internal combustion engine according to the first embodiment.

As illustrated in FIG. 1, the ignition unit 1 for an internal combustion engine according to the present embodiment is comprised of a power source unit (battery) 11 for supplying electric energy for discharge (e.g. having a voltage of 12V), a spark plug 13 provided in a cylinder of the internal combustion engine, an ignition coil 15 including a primary wiring L1 and a secondary wiring L2, a npn transistor 17 serially connected to the primary wiring L1, a thyristor 21 connected to the primary wiring Li in a parallel manner for short-circuiting both ends of the primary wiring L1, and an electronic control unit 19 (hereinafter referred to as "ECU") for respectively outputting a first instruction signal Sa and a second instruction signal Sb to the transistor 17 and the thyristor 21.

Among these, the transistor 17 is a switching element comprised of the above-described semiconductor element for switching between an energized and deenergized condition of the primary wiring L1 of the ignition coil 15, wherein the ignition unit for an internal combustion engine 1 according to the present embodiment is an ignition unit of full-transistor type.

One end of the primary wiring L1 is connected to a positive terminal of the power source unit 11 and the other end thereof is connected to a collector of the transistor 17. One end of the secondary wiring L2 is connected to the one end of the primary wiring L1 that is connected to the positive terminal of the power source unit 11 through a rectifying element D, while the other end thereof connected to a central electrode 13*a* of the spark plug 13. On outer electrode 13*b* of the spark plug 13 is grounded on a ground of a same potential as that of a negative terminal of the power source unit 11, a base of the transistor 17 is connected to the ECU 19 and an emitter of the transistor 17 is grounded. The thyristor 21 is arranged in that a cathode thereof is connected to a connecting end between the primary wiring L1 and the power source unit 11, an anode thereof to a connecting end between the primary wiring L1 and the transistor 17, and a gate thereof to the ECU 19.

When the first instruction signal Sa that is output from the ECU 19 to the transistor 17 is of low level (generally a ground potential), no base current is made to flow to the transistor 17 such that the transistor 17 is in an OFF condition, and no current is made to flow to the primary wiring L1 through the transistor 17. When the first instruction signal Sa is of high level, the transistor 17 is switched ON to form a energizing path for the primary wiring L1 extending from the positive terminal side of the power source unit 11 through the primary wiring L1 of the ignition coil 15 and to the negative terminal side of the power source unit 11 such that a primary current i1 is made to flow through the primary wiring L1.

Thus, when the first instruction signal Sa is of high level and the first instruction signal Sa is switched to low level in a condition the primary current i1 is made to flow through the primary wiring L1, the transistor 17 is turned OFF to terminate (interrupt) energizing of the primary current i1 to the primary wiring L1. A high voltage for ignition is accordingly generated in the secondary wiring L2 of the ignition coil 15 and upon applying this voltage on the spark plug 13, spark discharge is generated between the electrodes 13*a*–13*b* of the spark plug 13.

It should be noted that the ignition coil 16 is arranged in that a negative high voltage for ignition that is lower than the ground potential is generated on the central electrode 13*a* side of the spark plug 13 upon interrupting energizing to the primary wiring L1 by the transistor 17, and the secondary current i2 flowing to the secondary wiring L2 accompanying the spark discharge is flown to the primary wiring L1 side from the central electrode 13*a* of the spark plug 13 and through the secondary wiring L2. The rectifying element D comprised by a diode or the like is provided at a connecting portion between the secondary wiring L2 and the primary wiring L1 for permitting flow of current from the secondary wiring L2 to the primary wiring L1 side and preventing current flow in a reverse direction. In the present embodiment, the rectifying element D is comprised by a diode which anode is connected to the secondary wiring L2 and its cathode to the primary wiring L1, and by the action of the rectifying element D, current is prevented from flowing to the secondary wiring L2 when the transistor 17 is turned ON (energizing of the primary wiring L1 is started).

When the second instruction signal Sb output from the ECU 19 to the thyristor 21 is of low level, the thyristor 21 will be in an OFF condition so that both ends of the primary wiring L1 will not be short-circuited by the thyristor 21. When the second instruction signal Sb is of high level, the thyristor 21 will be in an ON condition so that both ends of the primary wiring L1 of the ignition coil 15 will be short-circuited to form a closed loop by the primary wiring L1 and the thyristor 21. It should be noted that the current flowing to the primary wiring Li when the thyristor 21 is in the ON condition is permitted to flow only in a direction identical to the direction of flowing when the transistor 17 is in the ON condition.

Figure 2:
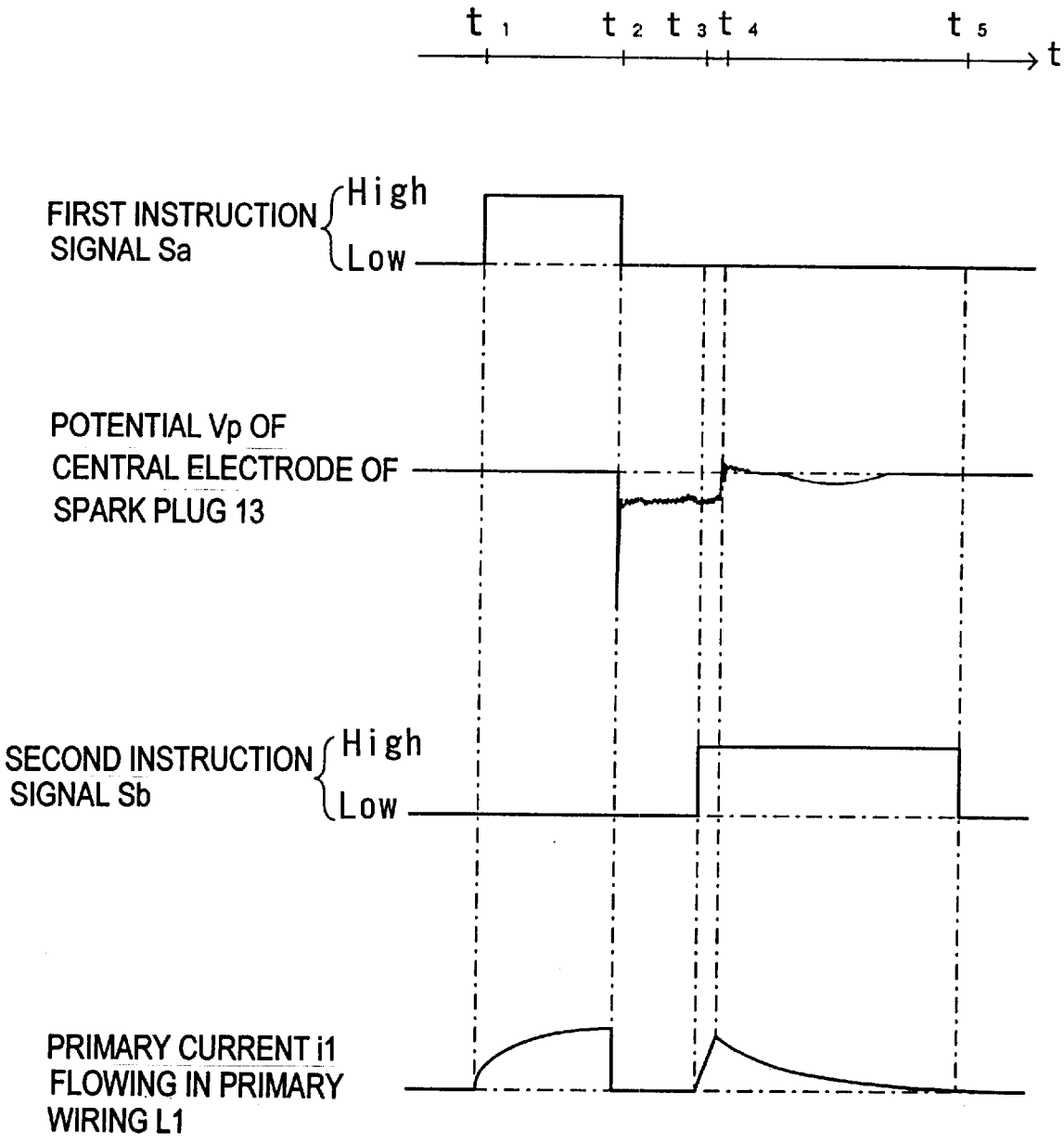
FIG. 2 is a time chart representing conditions of respective portions of the ignition unit for an internal combustion engine according to the first embodiment.

Next, a time chart for representing respective conditions of the first instruction signal Sa, second instruction signal Sb, potential Vp of the central electrode 13*a* of the spark plug 13, and the primary current i1 flowing to the primary wiring L1 of the ignition coil 15 in the circuitry view as illustrated in FIG. 1 is represented in FIG. 2.

The first instruction signal Sa is switched from low to high level at timing t1 in FIG. 2 for making the primary current i1 flow to the primary wiring L1 of the ignition coil 15, and when the first instruction signal Sa is switched from high to low level at timing t2 thereafter upon elapse of a preliminary set energizing time for interrupting energizing of the primary current i1 to the primary wiring L1 of the ignition coil 15, a negative high voltage for ignition is applied to the central electrode 13*a* of the spark plug 13 such that the potential Vp thereof is abruptly decreased to generate spark discharge between the electrodes 13*a*–13*b* of the spark plug 13.

At timing t3 after elapse of a spark discharge duration calculated on a basis of the operating condition of the internal combustion engine upon generation of spark discharge between the electrodes 13*a*–13*b* of the spark plug 13, the second instruction signal Sb is switched from low to high level to set the thyristor 21 to an ON condition for short-circuiting both ends of the primary wiring L1 such that the primary current i1 starts to flow through the closed loop formed by the primary wiring L1 and the thyristor 21 by the magnetic flux remaining in the ignition coil 15. When the primary current i1 is gradually increased such that the primary current i1 reaches a current value that may be generated by the magnetic flux remaining in an iron core of the ignition coil 15 (timing t4), voltage, which is of opposite polarity to that of the high voltage for ignition that had been generated in the secondary wiring L2 at the time of spark generation, is induced to the secondary wiring L2 such that the spark discharge of the spark plug 13 is forcibly interrupted.

It should be noted that the value of the primary current i1 when forcibly interrupting the spark discharge of the spark plug 13 (hereinafter referred to as "spark interrupting current value itc") is determined by magnetic flux magnetic field properties (B-H properties) of the ignition coil 15. More particularly, the spark discharge is interrupted since voltage of a polarity opposite to that of the high voltage for ignition is induced to the secondary wiring L2 when the magnetic field H [A/m] generated by the primary current i1 has reached a magnetic field H corresponding to magnetic flux B [T] remaining in the ignition coil 15 in view of the B-H properties. The current value of the primary current i1 at which the magnetic field H generated in the ignition coil 15 by making the primary current i1 flow becomes the magnetic field H for interrupting the spark discharge is set to be the spark interrupting current value itc.

Since the B-H properties of the ignition coil 15 is such that the larger the magnetic flux B becomes, the larger the magnetic field H becomes, the larger the magnetic flux B remaining in the ignition coil 15 becomes, the larger the spark interrupting current value itc becomes.

Therefore, the larger the magnetic flux B remaining in the ignition coil 15 is, the longer the time for reaching the spark discharge interrupting current value itc will be after switching the thyristor 21 to the ON condition (hereinafter referred to as "turnaround time for reaching current Ts").

When the primary current ii has reached the spark interrupting current value itc and spark discharge of the spark plug 13 is interrupted, the primary current i1, which had been increasing so far, starts to decrease. When energizing of the primary current i1 is continued, the magnetic flux remaining in the ignition coil 15 will be consumed through internal resistance of the primary wiring L1 such that the primary current i1 is gradually reduced, and the primary current i1 is terminated upon consumption of the magnetic flux. At this time (timing t5), the second instruction signal Sb is switched from high to low level to turn the thyristor 21 off, and the closed loop formed by the primary wiring L1 and the thyristor 21 is released. In this manner, the spark discharge in one combustion cycle of the internal combustion engine is completed.

Figure 3:
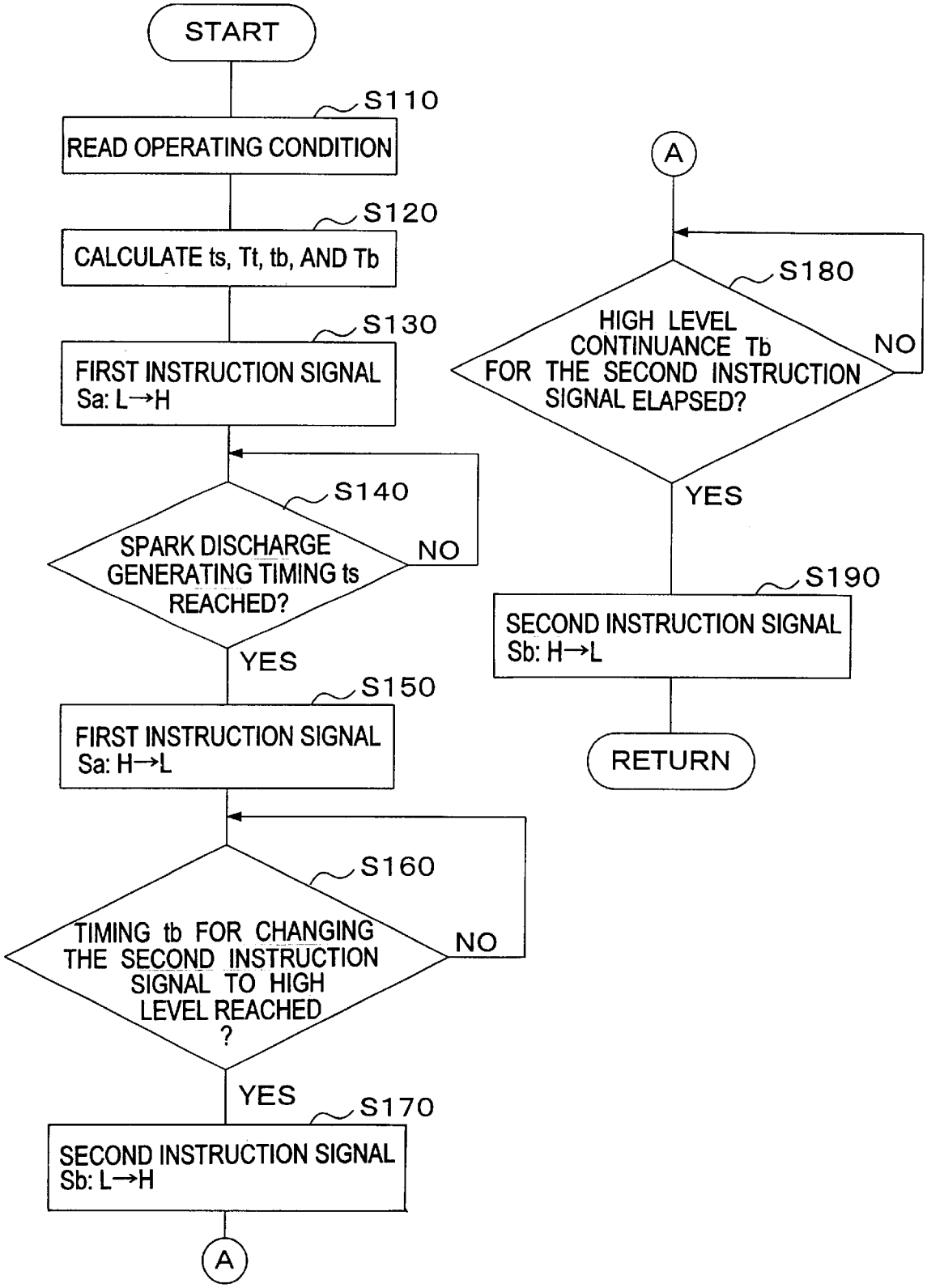
FIG. 3 is a flowchart representing ignition controlling processes performed by an electronic control unit (ECU)
Figure 4A:
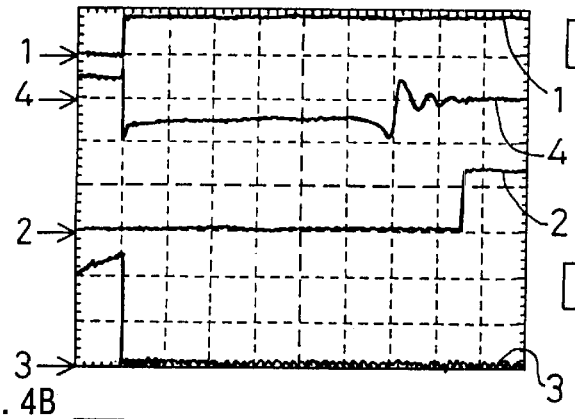
FIGS. 4A–4D are graphs representing results obtained by measuring primary currents and secondary voltages upon varying the spark discharge duration.
Figure 4B:
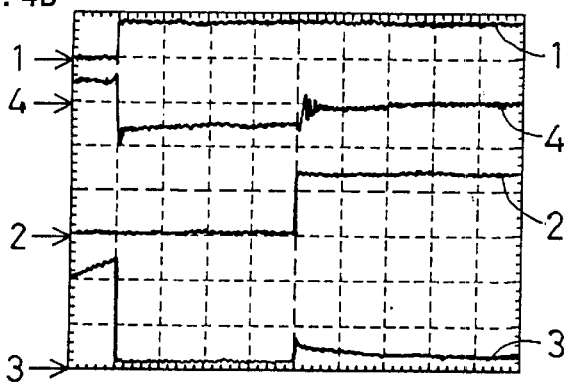
Figure 4C:
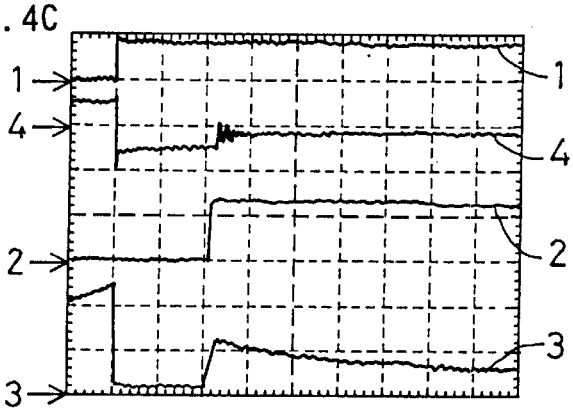
Figure 4D:
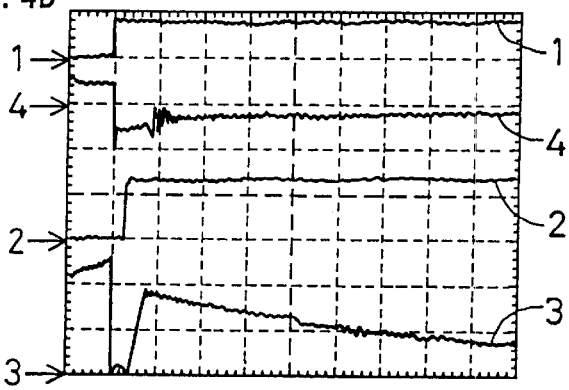

Ignition controlling processes performed in the ECU 19 will now be explained with reference to the flowchart as illustrated in FIG. 3.

It should be noted that the ECU 19 is provided for comprehensively controlling a spark discharge generating timing, fuel jetting amount, or number of idling revolution etc. of the internal combustion engine, and further performs operating condition detecting processes for detecting operating conditions of respective parts of the engine by detecting an intake air amount (intake pressure) of the internal combustion engine, revolution speed, throttle opening, temperature of cooling water or intake temperature etc. for performing ignition controlling processes that will be explained hereinafter.

The ignition controlling process as illustrated in FIG. 3 is performed once per each combustion cycle wherein the internal combustion engine performs suction, compression, combustion and exhaustion based on a signal from a crank angular sensor for detecting a rotation angle of the internal combustion engine (crank angle).

When this ignition controlling process is started, the operating condition of the engine as detected in a separate operating condition detecting process is first read in S110 (wherein S represents a Step), whereupon spark discharge generating timing (so-called ignition timing) ts, spark discharge duration Tt, timing tb for changing the second instruction signal Sb to high level, and a high level continuance Tb for the second instruction signal Sb are calculated in S120 based on the read operating condition.

It should be noted that the spark discharge generating timing ts is calculated by the steps of, for instance, obtaining a control reference value using a map or a calculation formula using an intake air amount and revolution speed of the internal combustion as parameters and correcting these based on temperature of cooling water or intake temperature.

The spark discharge duration Tt is calculated using a preliminarily set map or a calculation formula based on, for instance, the revolution speed of the internal combustion engine and the throttle opening that represents load applied on the engine such that the duration becomes long in an operating condition in which the spark energy required for combusting the mixed gas is large (e.g. low-load and low-rotation condition of the internal combustion engine) and that the duration becomes short in an operating condition in which the spark energy may be small (e.g. high-load and high-rotation condition).

The timing tb for changing the second instruction signal Sb to a high level is set to be a timing preceding the spark interrupting timing by the turnaround time for reaching current Ts such that the spark discharge may be interrupted at a spark interrupting timing after elapse of spark discharge duration Tt from the spark discharge generating timing ts. The turnaround time for reaching current Ts is calculated using a preliminarily set map or a calculation formula based on, for instance, the spark discharge duration Tt such that the time is short when the spark discharge duration Tt is long (when the amount of magnetic flux B remaining in the ignition coil 15 is small) and that the time is long when the spark discharge duration Tt is short (when the amount of magnetic flux B remaining in the ignition coil 15 is large).

The high level continuance Tb for the second instruction signal Sb is calculated using a preliminarily set map or a calculation formula based on, for instance, the spark discharge duration Tt such that the thyristor 21 is kept in the ON condition until the magnetic flux B remaining in the ignition coil 15 has been consumed. It should be noted that the high level continuance Tb for the second instruction signal Sb is set such that the duration is short when the spark discharge duration Tt is long (when the amount of magnetic flux B remaining in the ignition coil 15 is small) and that the duration is long when the spark discharge duration Tt is short (when the amount of magnetic flux B remaining in the ignition coil 15 is large).

Next, in S130, a timing for starting energizing of the primary wiring L1 is obtained that is preceding the spark discharge generating timing to as calculated in S120 by the preliminarily set time for energizing the primary wiring L1, and the first instruction signal Sa is changed from low to high level at a point the energizing starting timing has been reached (timing t1 as illustrated in FIG. 2).

When the first instruction signal Sa is switched from. low to high level in the process of S130, the transistor 17 comes to the ON condition whereby the primary current i1 is flown to the primary wiring L1 of the ignition coil 15. The time for energizing the primary wiring L1 up to the spark discharge generating timing ts is preliminary set such that this time corresponds to a time required for storing maximum spark energy in the ignition coil 15 necessary for combusting the mixed gas in various operating conditions of the internal combustion engine.

It is then determined in S140 based on a detection signal from the crank angular sensor whether the spark discharge generating timing to as calculated in S120 has been reached, and if it is determined NO, the spark discharge generating timing ts is awaited by repeatedly performing this step. When it is determined in S140 that the spark discharge generating timing ts has been reached (timing t2 as illustrated in FIG. 2), the process proceeds to S150.

In S150, the first instruction signal Sa is inverted from high to low level as illustrated by timing t2 in FIG. 2.

Accordingly, the transistor 17 is turned off to interrupt the primary current i1 so that high voltage for ignition is induced to the secondary wiring L2 of the ignition coil 15, and spark charge is thus generated between electrodes 13*a*–13*b* of spark plug 13.

Thereafter, it is then determined in S160 whether the timing tb for changing the second instruction signal Sb to high level, which has been set to interrupt spark discharge at spark discharge duration Tt as calculated in S120, has been reached after it has been determined in S140 that the spark discharge generating timing ts has been reached, and if it is determined NO, the timing tb for changing the second instruction signal Sb to high level is awaited by repeatedly performing this step. When it is determined in S160 that the timing tb for changing the second instruction signal Sb to high level has been reached (timing t3 as illustrated in FIG. 2), the process proceeds to S170 and the second instruction signal Sb is switched from low to high level The thyristor 21 is thus switched to the ON condition and the primary current i1 starts to flow in the closed loop formed by the primary wiring L1 and the thyristor 21 by the magnetic flux remaining in the ignition coil 15. When the primary current i1 increases to reach spark interrupting current value itc (timing t4 as illustrated in FIG. 2), spark discharge of the spark plug 13 is forcibly interrupted. Thereafter, the magnetic flux remaining in the ignition coil 15 is consumed through internal resistance of the primary wiring L1, and the primary current i1 flowing through the closed loop of the primary wiring L1 and the thyristor 21 is decreased.

In the following S180, after it has been determined YES in S160, it is determined whether the high level continuance Tb for the second instruction signal Sb as calculated in S120 has been elapsed or not, and if it is determined YES, the program proceeds to S190, and if NO, the program awaits by repeatedly performing the same step.

When the high level continuance Tb for the second instruction signal Sb has elapsed, it is determined YES in S180 (timing t5 as illustrated in FIG. 2) and the program proceeds to S190 whereupon the second instruction signal Sb is inverted from high to low level in S190 for terminating the current ignition controlling process.

It should be noted that while the value for the high level continuance Tb for the second instruction signal Sb is set in S120 based on the spark discharge duration Tt in the present embodiment, it is also possible to employ a fixed value for the high level continuance Tb for the second instruction signal Sb irrespective of the length of the spark discharge duration Tt since both ends of the primary wiring are short-circuited by using the thyristor.

In other words, since the thyristor maintains the ON condition until the current reaches a substantially zero value owing to external conditions once the thyristor has been turned ON, and the thyristor 21 maintains the ON condition as long as the primary current i1 is made to flow even upon switching the second instruction signal Sb to low level. Therefore, the thyristor 21 maintains the ON condition until the primary current ii reaches a substantially zero value also in case the high level continuance Tb of the second instruction signal Sb is set to be shorter than a time in which the magnetic flux of the ignition coil is completely consumed and the second instruction signal Sb is inverted to low level. Thereafter, the thyristor 21 is automatically switched to the OFF condition at a point in time at which the primary current i1 has reached a substantially zero value, and both ends of the primary wiring L1 are released.

It is accordingly possible to release both ends of the primary wiring L1 at an optimal timing also when the high level continuance Tb of the second instruction signal Sb is set to be a fixed value without varying the duration in correspondence to the spark discharge duration Tt when using the thyristor. It should be noted that fixed value is set to be a value sufficiently large for switching the thyristor at least to the ON condition.

When using the thyristor 21, voltage of reverse bias is applied on the thyristor 21 when energizing of the primary wiring L1 prior to the spark discharge is started before the magnetic flux remaining in the ignition coil 15 is completely consumed, and both ends of the primary wiring L1 will be released. It is thereby possible to prevent erroneous short-circuiting of both ends of the primary wiring when energizing the primary wiring prior to the spark discharge and to prevent interference of storage of spark energy by the ignition coil.

It should be noted that when using, for instance, a transistor releasing both ends of the primary wiring by the inversion of the second instruction signal Sb from high to low level instead of the thyristor 21, it is possible to perform normal ignition controlling processes by setting the high level continuance Tb for the second instruction signal Sb based on the spark discharge duration Tt as in the present embodiment.

At timing t5 as illustrated in FIG. 2, the primary current i1 is substantially a zero value so that the thyristor 21 comes OFF simultaneously with the second instruction signal Sb coming to the low level.

It should be noted that in the time chart of FIG. 2, timing t2 corresponds to the spark discharge generating timing ts, the time between timing t2 and timing t4 to the spark discharge duration Tt, timing t3 to the timing tb for changing the secondary instruction Sb to high level, the time between timing t3 to timing t5 to the high level continuance Tb for the second instruction signal Sb, and the time between timing t3 to timing t4 to the turnaround time for reaching current Ts, respectively.

As explained so far, in the ignition unit for an internal combustion engine 1 according to the present embodiment, high voltage for ignition induced to the secondary wiring L2 of the ignition coil 15 is applied on the spark plug 13 upon turning the transistor 17 ON/OFF by the ECU 19 through first instruction signal Sa, and spark discharge is generated between electrodes 13*a*–13*b* of the spark plug 13. Then, for forcibly interrupting spark discharge at spark discharge duration Tt as calculated based on the operating condition of the internal combustion engine, the ECU 19 inverts the second instruction signal Sb to high level for switching the thyristor 21 ON and makes current flow through the primary wiring L1 whereupon the spark discharge is forcibly interrupted.

For confirming that forcible interruption of spark discharge is enabled by the ignition unit for an internal combustion engine to which the present invention has been applied, spark interruption was actually performed and values of the primary current i1 flowing through the primary wiring of the ignition coil 15 and the secondary voltage Vp flowing through the secondary wiring L2 at this time were measured.

Measurement was performed in the following condition: spark discharge was generated by setting the battery voltage to 12[V], the primary wiring energizing time prior to the spark discharge to 4 [ms], and the primary current i1 at the time of interruption of energizing to 5 [A] whereupon the spark discharge duration Tt was varied to record variations in the primary current values i1 and secondary voltage values Vp per each spark discharge duration Tt. Measurement was performed for the following four conditions for the spark discharge duration Tt: (a) spark discharge was not forcibly interrupted; (b) the spark discharge duration Tt was 2.0 [mS]; (c) the spark discharge duration Tt was 1.0 [mS]; and (d) the spark discharge duration Tt was 0.5 [mS].

Results of measurement are represented as waveforms (graphs) in FIGS. 4A–4D. It should be noted that each result of measurement (a) to (d) represents four waveforms for IG signals, thyristor gate signals, primary current values i1, and secondary voltage values (potential of central electrode of the spark plug) Vp, wherein a horizontal scale for each of the waveforms is 0.5 [mSec], and a position of an arrow of each waveform number represents a zero level that serves as a reference for each waveform of a vertical axis.

Each Waveform 1 represents an IG signal corresponding to the first instruction signals Sa with a vertical scale of (5V/DIV), wherein a low level of the IG signal (0[V]) corresponds to the high level of the first instruction signal Sa and a high level of the IG signal (5[V]) to the low level of the first instruction signal Sa.

Next, each waveform 2 represents a thyristor gate signal corresponding to the second instruction signal Sb with a vertical scale of (5V/DIV), wherein a low level of the thyristor gate signal (0[V]) corresponds to the low level of the second instruction signal Sb and a high level of the thyristor gate signal (7[V]) to the high level of the second instruction signal Sb.

Each waveform 3 represents the primary current i1, having a vertical scale of (2 A/DIV), and each waveform 4 represents the secondary voltage Vp, having a vertical scale of (1 kV/DIV).

(a) When Spark Discharge is not Forcibly Interrupted

In this case, spark discharge is started after the IG signal (waveform 1) has inverted from low to high level and the secondary voltage Vp is largely changed to a negative side, and the voltage value is changed after elapse of approximately 3.0 [mS] from the generation of spark discharge to come to 0[V] and the spark discharge is spontaneously interrupted.

(b) When the Spark Discharge Duration Tt is 2.0 [mS]

In this case, when the thyristor gate signal (waveform 2) is inverted from low to high level after start of spark discharge, the primary current i1 (waveform 3) is increased to reach approximately 1.2 [A] whereupon the secondary voltage Vp (waveform 4) is changed to come to 0[V] so that spark discharge is forcibly interrupted. At this time, the time between a point in time at which the thyristor gate signal has reached a high level and a point in time at which spark discharge is interrupted is not more than 0.1 [mSec].

(c) When the Spark Discharge Duration Tt is 1.0 [mS]

In this case, when the thyristor gate signal (waveform 2) is inverted from low to high level after start of spark discharge, the primary current i1 (waveform 3) starts to increase as to reach approximately 2.5 [A] whereupon the secondary voltage Vp (waveform 4) changes to come to 0[V] so that spark discharge is forcibly interrupted. At this time, the time between a point in time at which the thyristor gate signal has reached a high level and a point in time at which spark discharge is interrupted is approximately 0.1 [mSec].

(d) When the Spark Discharge Duration Tt is 0.5 [mS]

In this case, when the thyristor gate signal (waveform 2) is inverted from low to high level after start of spark discharge, the primary current i1 (waveform 3) starts to increase as to reach approximately 3.9 [A] whereupon the secondary voltage Vp (waveform 4) changes to come to 0[V] so that spark discharge is forcibly interrupted. At this time, the time between a point in time at which the thyristor gate signal has reached a high level and a point in time at which spark discharge is interrupted is approximately 0.2 [mSec].

It is understood from the above results of measurements that it is possible to vary the spark discharge duration Tt by using the ignition unit for an internal combustion engine of the present invention. However, it was also found that the shorter the spark discharge duration Tt becomes, the longer the time between the point in time at which the thyristor gate signal has reached a high level and the point in time at which spark discharge is interrupted is, so that there are limitations for reducing the spark discharge duration Tt. Nevertheless, a minimum spark discharge duration Tt required in actual use for operating the internal combustion engine being 0.2 [mSec], it has been confirmed by the inventors of the present invention that this spark discharge duration Tt can be set to 0.2 [mSec] in actual measurement so that it is possible to employ the ignition unit for an internal combustion engine of the present invention for actual use.

Figure 5:
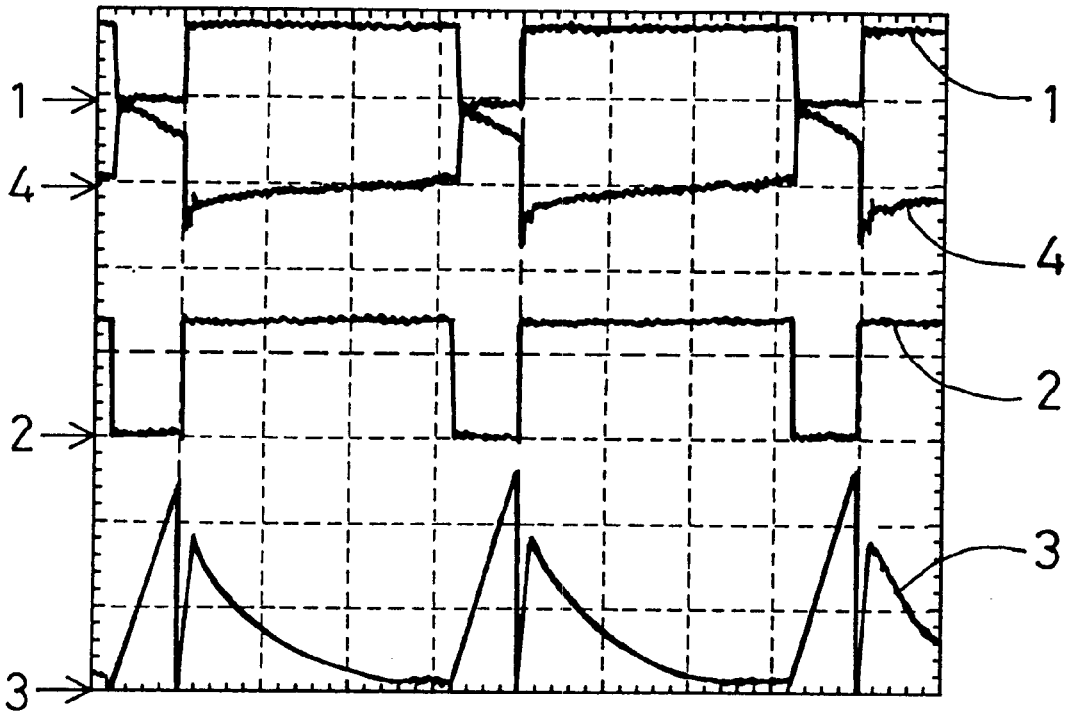
FIG. 5 is a graph representing results obtained by measuring the primary current and the secondary voltage upon performing spark discharge for a plurality of times.

FIG. 5 illustrates a plurality of spark discharge waveforms when the spark discharge duration Tt is set to 0.5 [mSec]. It should be noted that the horizontal scale is 5 [mSec] and each position of the arrow of each waveform represents a zero level of the vertical axis serving as a reference for each waveform. Waveform 1 represents the IG signal, waveform 2 the thyristor gate signal, waveform 3 the primary current i1 and waveform 4 the secondary voltage Vp (potential of central electrode of spark plug), wherein ranges of the respective waveforms are similar to those of FIG. 4.

Spark discharge is performed at 2 [mSec] times (corresponding to 3,000 rpm) in FIG. 5, and each spark discharge is forcibly interrupted with the spark discharge duration Tt being set to 0.5 [mSec].

As illustrated in FIG. 5, the IG signal (waveform 1) comes to a high level when the primary current ii (waveform 3) is increased to be 5 [A] such that the primary current i1 is interrupted to generate spark discharge, and the thyristor gate signal (waveform 2) comes to a high level such that the spark discharge duration Tt becomes 0.5 [mSec]. When the primary current i1 (waveform 3) is then increased to reach the spark interrupting current value itc, the spark discharge is interrupted. Further, when the primary current i1 decreases with time such that the primary current i1 substantially becomes a zero value, the thyristor gate signal comes to a low level. Simultaneously, the IG signal (waveform 1) comes to a high level and the primary current i1 is again energized to increase for storing spark energy for the following spark discharge. When the ignition timing is reached, the IG signal comes to a low level to generate again spark discharge. By repeating these steps for periodically generating spark discharge that is to be forcibly interrupted, ignition of the mixed gas is performed.

It can be understood from these results of measurement that it is possible to interrupt sparks of periodical spark discharges by using the ignition unit for an internal combustion engine to which the present invention has been applied.

From the above results of measurement, the spark discharge duration Tt can be varied in a range required for actual use and that spark interruption of periodically performed spark discharge is enabled by using the ignition unit for an internal combustion engine to which the present invention has been applied. With this arrangement, it is enabled to prevent excess supply of spark energy to the spark plug and to prevent useless promotion of exhaustion of electrodes of the spark plug by setting the spark discharge duration Tt based on operating conditions of the internal combustion engine for performing ignition of mixed gas.

When using such an ignition unit for an internal combustion engine to a gas engine using a gaseous fuel such as methane gas etc. in which a maximum secondary voltage for the ignition coil is set to be high, it is possible to effectively restrict useless exhaustion of electrodes of the spark plug and to increase the life of the spark plug.

Second Embodiment

Figure 6:
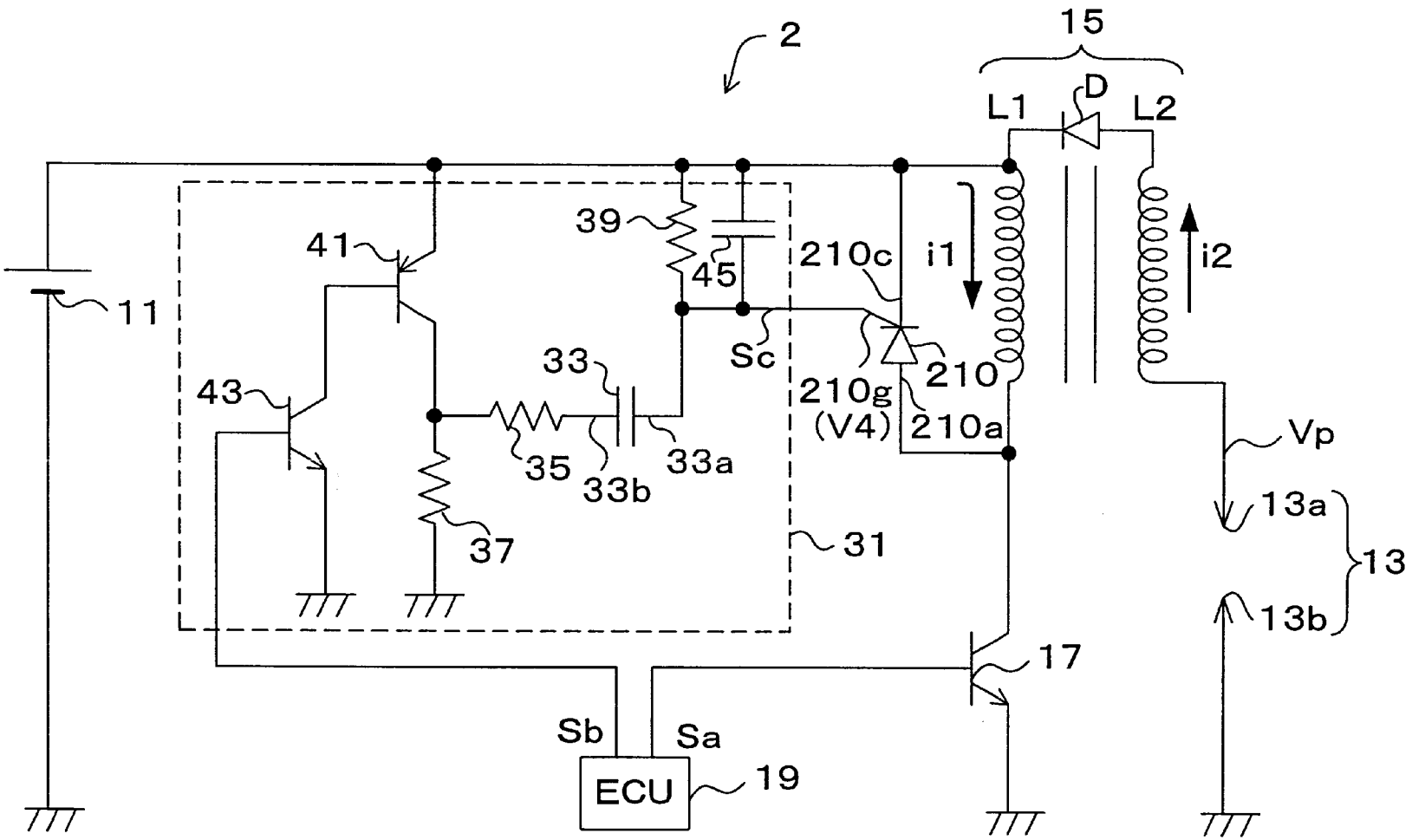
FIG. 6 is an electric circuitry view representing an arrangement of the ignition unit for an internal combustion engine according to a second embodiment.

As illustrated in FIG. 6, the ignition unit for an internal combustion engine 2 according to the second embodiment is comprised, similarly to the ignition unit for the internal combustion engine 1 according to the first embodiment, a power source unit (battery) 11 for outputting a power source voltage Vb (e.g. a voltage of 12V) for supplying electric energy for spark discharge, a spark plug 13 provided in a cylinder of the internal combustion engine, an ignition coil 15 including a primary wiring L1 and a secondary wiring L2, a transistor 17 comprised by a npn power transistor serially connected to the primary wiring L1, a thyristor 210 connected to the primary wiring L1 in a parallel manner for short-circuiting both ends of the primary wiring L1, and an electronic control unit (ECU) 19. The ignition unit 2 of the second embodiment differs from that of the first embodiment in that it further comprises a thyristor driving circuit 31 for outputting a driving signal Sc for driving the thyristor 210, and first instruction signals Sa and second instruction signals Sb are respectively output from the ECU 19 to the transistor 17 and the thyristor driving circuit 31.

Components that are marked with the same reference numerals as those of the first embodiment exhibit functions similar to those of the first embodiment so that explanations thereof will here be omitted.

The thyristor driving circuit 31, which is a distinctive component of the second embodiment, will now be explained.

The thyristor driving circuit 31 is comprised of a condenser 33 with a first terminal 33*a* thereof being connected to a positive terminal of the power source unit 11 through a resistor 39, a resistor 35 which one end is connected to a second terminal 33*b* of the condenser 33 while the other end is connected, through a resistance 37, to a ground of same potential as a negative terminal of the power source unit 11, a first interruption controlling transistor 41 comprised by a pnp transistor with an emitter thereof being connected to a positive terminal of the power source unit 11, a second interruption controlling transistor 43 comprised by a npn transistor with a collector thereof being connected to a base of the first interruption controlling transistor 41, and a noise eliminating condenser 45 connected between the first terminal 33*a* of the condenser 33 and the positive terminal of the power source unit 11.

The first terminal 33*a* of the condenser 33 is connected to a gate 210*g* of the thyristor 210. A collector of the first interruption controlling transistor 41 is connected to a connecting point between the resistor 35 and the resistor 37. A base of the second interruption controlling transistor 43 is connected to an output terminal of the ECU 19 for the second instruction signal Sb, and an emitter thereof is connected to a ground of a same potential as the negative terminal of the power source unit 11.

In the thus arranged thyristor driving circuit 31, the second interruption controlling transistor 43 is in an OFF condition when the signal that is input to the base of the second interruption controlling transistor 43 is of low level (generally a ground potential), and the first interruption controlling transistor 41 will also be in an OFF condition. At this time, a current path is formed that extends from the positive terminal of the power source unit 11 through the resistor 39, condenser 33, resistor 35, and resistor 37 and to the negative terminal of the power source unit 11, and the condenser 33 is charged until a voltage becomes equal to a power source voltage Vb of the power source unit 11. The condenser 33 is charged such that the first terminal 33*a* is of high potential and the second terminal 33*b* of low potential.

When a signal that is input to the base of the second interruption controlling transistor 43 is of high level (generally a driving voltage for the ECU (e.g. 5[V]), a potential difference is generated between the base and the emitter of the second interruption controlling transistor 43 such that current is made to flow, and the second interruption controlling transistor 43 is turned ON. Accompanying this, the potential of the base of the first interruption controlling transistor 41 comes to a low level such that a potential difference is generated between the emitter and base of the first interruption controlling transistor 41 such that current is made to flow, and the first interruption controlling transistor 41 is turned ON. A closed loop will be accordingly formed by the condenser 33, resistor 39, first interruption controlling transistor 41 and the resistor 35 so that current is made to flow through the condenser 33, resistor 39, first interruption controlling transistor 41 and the resistor 35 in this order through discharge of the condenser 33. The resistor 35 restricts an amount of discharge current and prevents thyristor 210 from breaking.

The moment discharge is started by the condenser 33, the potential of the second terminal 33*b* of the condenser 33 becomes substantially equal to the potential Vb of the positive terminal of the power source unit 11, and the potential of the first terminal 33*a* of the condenser 38 becomes a potential corresponding to the potential Vb of the positive terminal of the power source unit 11 increment by the voltage Vb of the condenser at the time of charging. Thus, the moment discharge is started by the condenser 33, the potential of the first terminal 33*a* of the condenser 33 becomes 2 Vb and becomes a higher potential than at least the potential Vb of the positive terminal of the power source unit 11. Thereafter, the potential of the first terminal 33*a* is decreased accompanying the discharge of electric charge stored in the condenser 33 and finally comes to a value equal to the potential Vb of the positive terminal of the power source unit 11.

Thus, the thyristor driving circuit 31 outputs a driving signal Sc of low potential (low level), which is equal to the potential of the positive terminal of the power source unit 11, to the gate 210*g* of the thyristor 210 when the second instruction signal Sb from the ECU 19 is of low level. Immediately after the second instruction signal Sb from the ECU 19 has changed from low level to high level, the circuit outputs a driving signal Sc, which is of higher potential (higher level) than the potential of the positive terminal of the power source unit 11, to the gate 210*g* of the thyristor 210.

Therefore, when the second instruction signal Sb that is output from the ECU 19 is of low level, the driving signal Sc that is output from the thyristor driving circuit 31 to the thyristor 210 will be of low level (potential Vb) so that the thyristor 21 will be in the OFF condition, and both ends of the primary wiring L1 will not be short-circuited.

Immediately after the second instruction signal Sb has been changed from low level to high level, the driving signal Sc that is output from the thyristor driving circuit 31 to the thyristor 210 will be of high level (potential 2 Vb) and the thyristor 210 will come to the ON condition (driving condition) so that both ends of the primary wiring L1 of the ignition coil 15 will be short-circuited and a closed loop is formed by the primary wiring L1 and the thyristor 210.

It should be noted that the thyristor 210 permits only current flowing in one direction at the time of short-circuiting, and current directed to the same direction as the current that is flown when the transistor 17 is in the ON condition is made to flow through the primary wiring which both ends have been short-circuited by the thyristor 210. Since a time of several [μs] to several tens of [μs] is required until the thyristor 210 comes to the driving condition after input of the driving signal to the gate thereof, the capacity of the condenser 33, and resistance values of the resistor 39 and the resistor 35 are suitably selected to make the gate 210*g* of the thyristor 210 maintain a gate potential that is of higher potential than the potential of the positive terminal of the power source unit 11.

Figure 7:
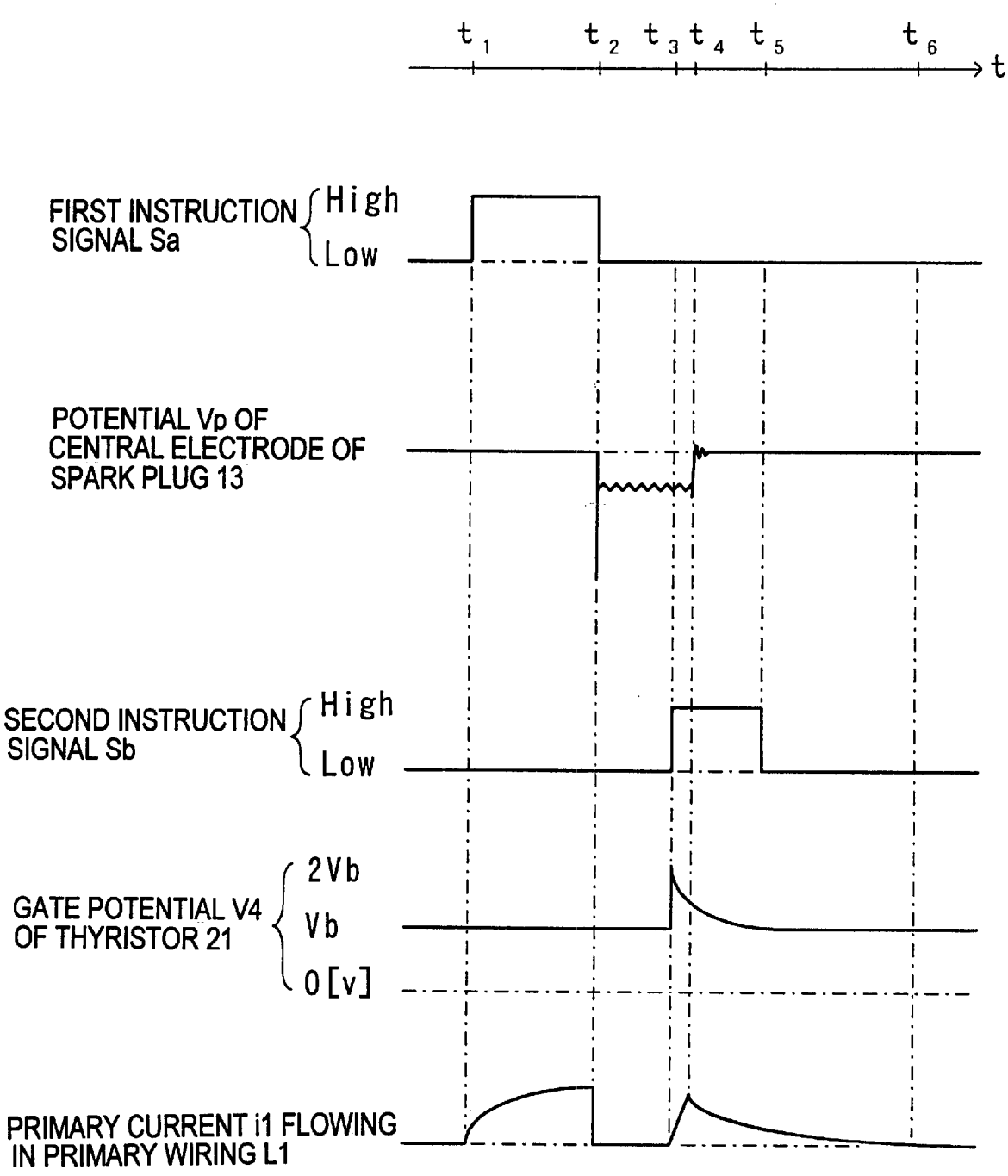
FIG. 7 is a time chart representing conditions of respective portions of the ignition unit for an internal combustion engine according to the second embodiment.

Next, a time chart illustrating respective conditions of the first instruction signal Sa, the second instruction signal Sb, the potential Vp of the central electrode 13*a* of the spark plug 13, the primary current i1 flowing through the primary wiring L1 of the ignition coil 15, and the gate potential V4 of the thyristor 210 of the circuitry of FIG. 6 is illustrated in FIG. 7.

When the first instruction signal Sa is switched from low to high level at timing t1 in FIG. 7, the primary current i1 starts to flow in the primary wiring L1 of the ignition coil 15, and when the first instruction signal Sa is switched thereafter from high to low level at timing t2 after elapse of a preliminary set primary wiring energizing time, energizing of the primary current i1 to the primary wiring L1 is interrupted. A negative high voltage for ignition generated in the second wiring L2 is accordingly applied on the central electrode 13*a* of the spark plug 13 so that its potential Vp is abruptly decreased and spark discharge is generated between electrodes 13*a*–13*b* of the spark plug 13.

When the second instruction signal Sb is switched from low to high level at timing t3 after elapse of a specified time after generation of spark discharge between electrodes 13*a*–13*b* of the spark plug 13, the thyristor 210 is switched to the ON condition by the action of the thyristor driving circuit 31, and both ends of the primary wiring L1 are short-circuited. The primary current i1 accordingly starts to flow in the closed loop formed by the primary wiring L1 and the thyristor 210 by the magnetic flux remaining in the ignition coil 15. This primary current i1 is gradually increased until the primary current i1 reaches a current value capable of being generated by the magnetic flux remaining in the iron core of the ignition coil 15 (timing t4), whereupon a voltage, which is of opposite polarity to the high voltage for ignition that had been generated in the secondary wiring L2 at the time of spark generation, is induced to the secondary wiring L2 so that spark discharge at the spark plug 13 is forcibly interrupted.

When the primary current i1 reaches the spark interrupting current value itc and spark discharge at the spark plug 13 is interrupted, the primary current i1, which had been increasing so far, starts to decrease accompanying the decrease in magnetic flux energy that had been stored in the ignition coil.

Further, when the voltage of the condenser 33 decreases accompanying the discharge, the driving signal Sc decreases from high level (2 Vb) to low level (Vb) and the potential V4 of the gate 210*g* of the thyristor 210 finally decreases as far as Vb. However, the thyristor 210 maintains the ON condition as long as current (primary current i1) remains flowing even though the potential V4 of the gate 210*g* decreases to Vb.

By continuing energizing of the primary current i1, the magnetic flux remaining in the ignition coil 15 is consumed by the internal resistance of the primary wiring L1 to gradually decrease the primary current i1, and upon consumption of the magnetic flux, flow of the primary current i1 will be terminated (timing t6). At this time, the thyristor 210 automatically turns off through the termination of current and the closed loop formed by the primary current L1 of the thyristor 210 is released.

On the other hand, after reaching a high level, the second instruction signal Sb is switched from high to low level upon elapse of a specified time as preliminarily set by the ECU 19 (timing t5), and the driving signal Sc from the thyristor driving circuit 31 is completely terminated.

By performing this series of actions, forcible interruption of spark discharge during one combustion cycle of an internal combustion engine is performed.

Figure 8:
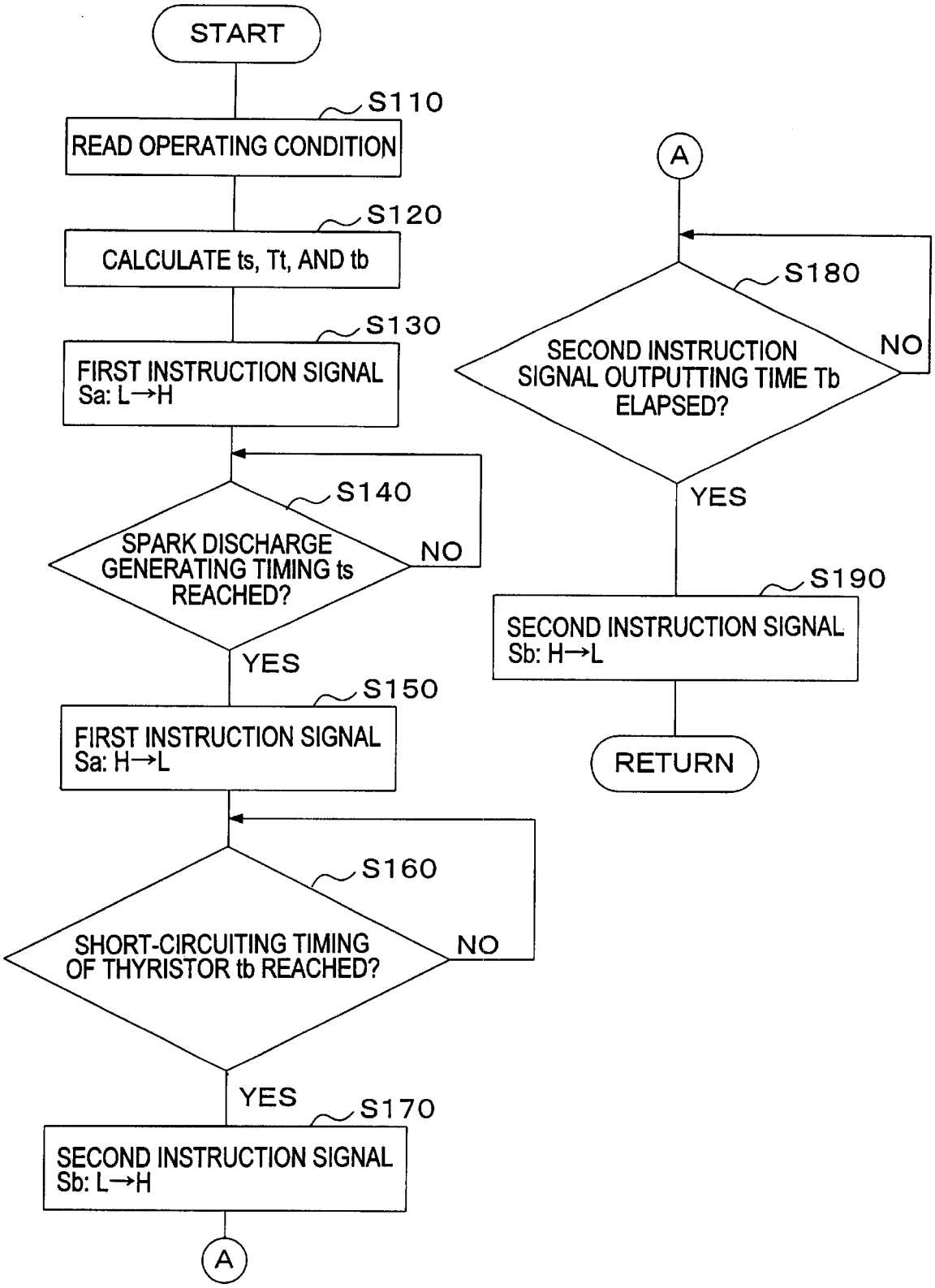
FIG. 8 is a flowchart of ignition controlling processes performed in an ECU of the second embodiment.

While the ignition controlling process as performed in ECU 19 is illustrated in the flowchart of FIG. 8, explanations thereof will be omitted here since it is similar to the process as performed in the first embodiment except for the point that Tb has been fixed.

Also in the second embodiment, high voltage for ignition that has been induced to the secondary wiring L2 of the ignition coil 15 is applied on the spark plug 13 by switching the transistor 17 ON/OFF by the ECU 19 through the first instruction signal Sa, and spark discharge is generated between electrodes 13*a*–13*b* of the spark plug 13. Then, for forcibly interrupting spark discharge at spark discharge duration Tt as calculated based on the operating condition of the internal combustion engine, the ECU 19 inverts the second instruction signal Sb to high level for actuating the thyristor driving circuit 31 for switching the thyristor 210 ON and makes current flow through the primary wiring L1 whereupon the spark discharge is forcibly interrupted.

The second embodiment is also capable of forcibly interrupting spark discharge, and thus to exhibit effects similar to those of the first embodiment.

Third Embodiment

Figure 9:
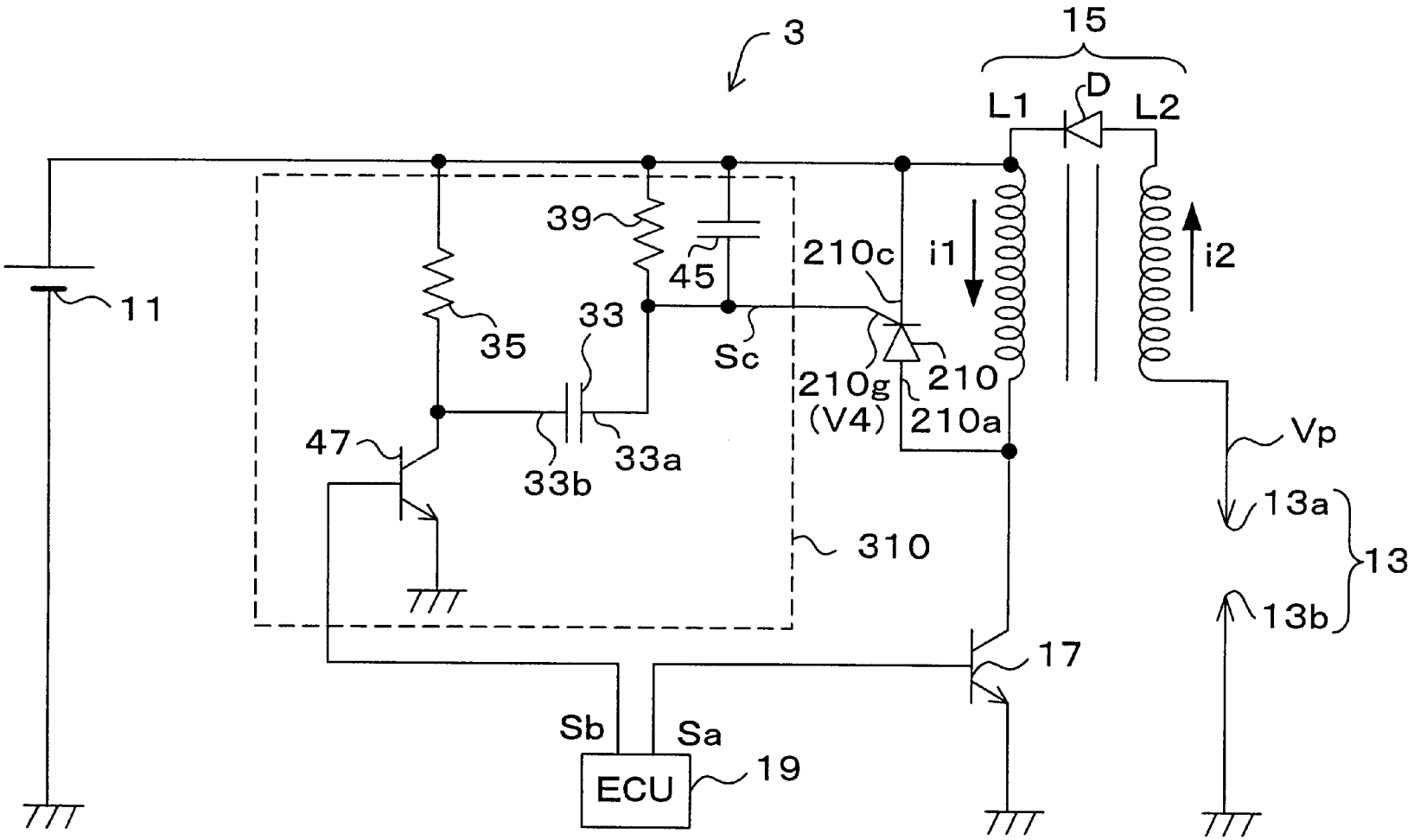
FIG. 9 is a an electric circuitry view representing an arrangement of an ignition unit for an internal combustion engine according to a third embodiment.

The ignition unit for an internal combustion engine according to a third embodiment will now be explained. FIG. 9 is an electric circuitry view showing an arrangement of the ignition unit for an internal combustion engine according to the third embodiment.

It should be noted that the ignition unit 3 for an internal combustion engine according to the third embodiment differs from the ignition unit 2 for an internal combustion engine according to the second embodiment in the arrangement of the thyristor driving circuit 31 and the ignition controlling process that is performed in the ECU 19, while remaining arrangements are identical. Thus, the following explanations will focus on the different points.

As illustrated in FIG. 9, the thyristor driving circuit 310 of the third embodiment is comprised of a condenser 33 with a first terminal 33*a* thereof being connected to a positive terminal of the power source unit 11 through a resistor 39, an interruption controlling transistor 47 comprised by a npn transistor with a collector thereof being connected to a second terminal 33*b* of the condenser 33, a resistor 35 which one end is connected to the second terminal 33*b* of the condenser 33 and the other end to the positive terminal of the power source unit 11, and a noise eliminating condenser 45 connected between the first terminal 33*a* of the condenser 33 and the positive terminal of the power source unit 11.

The first terminal 33*a* of the condenser 33 is connected to the gate 210*g* of the thyristor 210. An emitter of the interruption controlling transistor 47 is connected to a ground of identical potential as a negative terminal of the power source unit 11 and a base thereof to an output terminal of the ECU 19 for the second instruction signal Sb.

In the thyristor driving circuit 310 of the above arrangement, when a signal that is input to the base of the interruption controlling transistor 47 is of high level (generally a driving voltage for the ECU (e.g. 5[V]), a potential difference is generated between the base and the emitter of the interruption controlling transistor 47 such that current is made to flow, and the interruption controlling transistor 47 is turned ON. At this time, the second terminal 33*b* of the condenser 33 becomes substantially equal to the ground potential, and a current path is formed that extends from the positive terminal of the power source unit 11 through the resistor 39, the condenser 33, and the interruption controlling transistor 47 to the negative terminal of the power source unit 11, and the condenser 33 is charged until a voltage thereof becomes equal to power source voltage Vb of the power source unit 11. The condenser 33 is charged such that the first terminal 33*a* is of high potential and the second terminal 33*b* of low potential.

When a signal that is input to the base of the interruption controlling transistor 47 is of low level (generally a ground potential), the interruption controlling transistor 47 is turned OFF. A closed loop will be accordingly formed by the condenser 33, the resistor 39 and the resistor 35 so that current is made to flow through the condenser 33, resistor 39, and the resistor 35 in this order through discharge of the condenser 33.

The moment discharge is started by the condenser 33, the potential of the second terminal 33*b* of the condenser 33 becomes substantially equal to the potential Vb of the positive terminal of the power source device 11, and the potential of the first terminal 33*a* of the condenser 33 becomes a potential corresponding to the potential Vb of the positive terminal of the power source unit 11 increment by the voltage Vb of the condenser at the time of charging. Thus, the moment discharge is started by the condenser 33, the potential of the first terminal 33*a* of the condenser 33 becomes 2 Vb and becomes a higher potential than at least the voltage Vb of the positive terminal of the power source unit 11. Thereafter, the potential of the first terminal 33*a* is decreased accompanying the discharge of electric charge stored in the condenser 33 and finally comes to a value equal to the potential Vb of the positive terminal of the power source unit 11.

Thus, the thyristor driving circuit 310 of the third embodiment outputs a signal of low potential (low level), which is equal to the potential of the positive terminal of the power source unit 11, to the gate 210*g* of the thyristor 210 when the second instruction signal Sb from the ECU 19 is of high level. Immediately after the second instruction signal Sb from the ECU 19 has changed from high level to low level, the circuit outputs a signal, which is of higher potential (higher level) than the potential of the positive terminal of the power source unit 11, to the gate 210*g* of the thyristor 210.

Therefore, when the second instruction signal Sb that is output from the ECU 19 is of high level, the driving signal Sc that is output from the thyristor driving circuit 310 to the thyristor 210 will be of low level (potential Vb) so that the thyristor 210 will be in the OFF condition, and both ends of the primary wiring L1 will not be short-circuited by the thyristor 210. Immediately after the second instruction signal Sb has been changed from high level to low level, the signal that is output from the thyristor driving circuit 310 to the thyristor 210 will be of high level (potential 2 Vb) and the thyristor 210 in the ON condition (short-circuited condition) so that both ends of the primary wiring L1 of the ignition coil 15 will be short-circuited and a closed loop is formed by the primary wiring L1 and the thyristor 210.

In this manner, the thyristor driving circuit 310 of the third embodiment is arranged in that the condition of the driving signal Sc that is output to the thyristor 210 with respect to the condition of the input second instruction signal Sb is opposite to that of the second embodiment.

It should be noted that the thyristor 210 permits only current flowing in one direction at the time of short-circuiting, similar to the second embodiment, and current directed to the same direction as the current that is flown when the transistor 17 is in the ON condition is made to flow through the primary wiring which both ends have been short-circuited by the thyristor 210.

Figure 10:
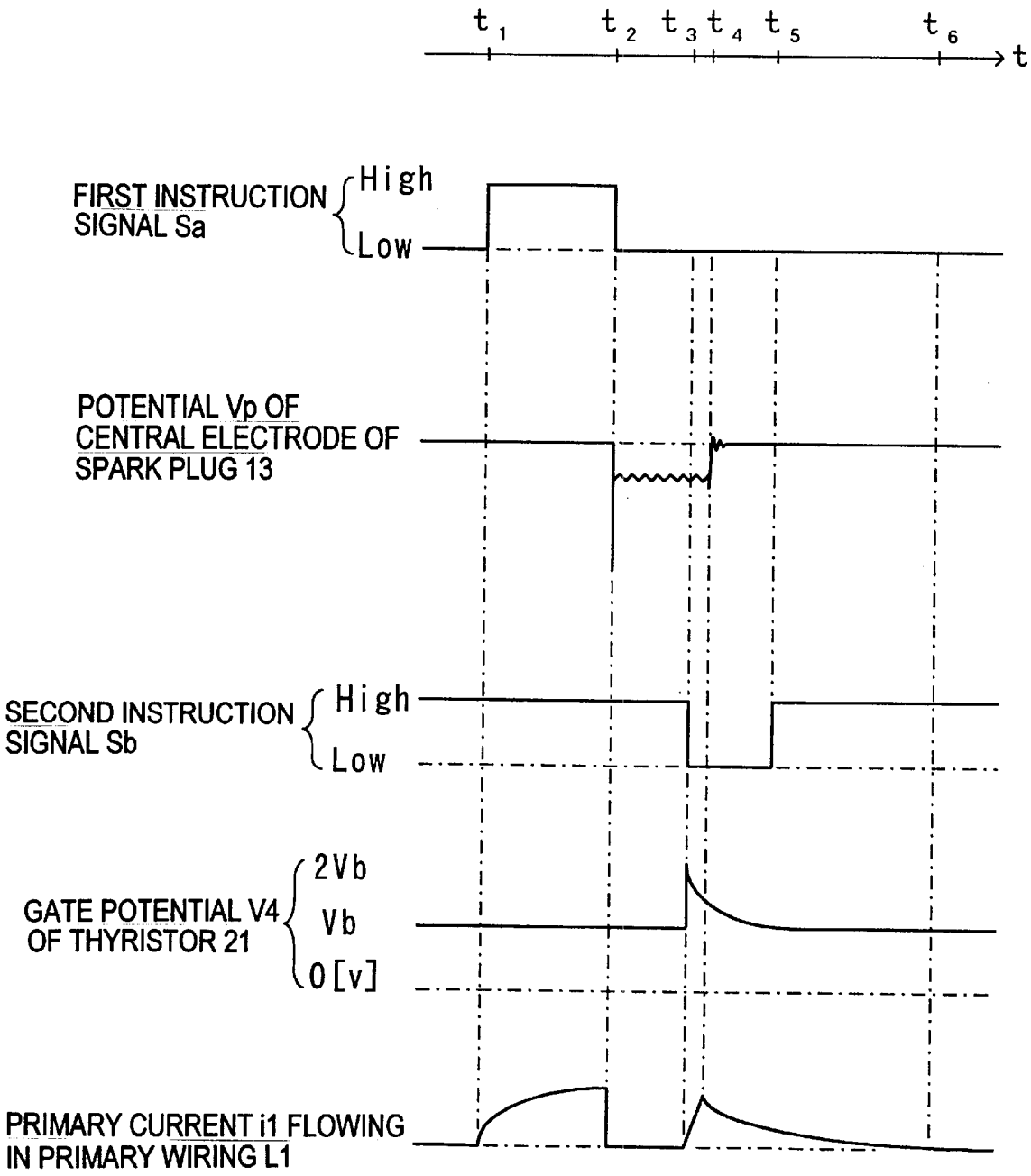
FIG. 10 is a time chart representing conditions of respective portions of the ignition unit for an internal combustion engine according to the third embodiment.

Next, a time chart illustrating respective conditions of the first instruction signal Sa, the second instruction signal Sb, the potential Vp of the central electrode 13*a* of the spark plug 13, the primary current i1 flowing through the primary wiring L1 of the ignition coil 15, and the gate potential V4 of the thyristor 210 of the circuitry of FIG. 9 is illustrated in FIG. 10.

As illustrated in FIG. 10, changes in the respective conditions of the ignition unit for an internal combustion engine of the third embodiment except for that of the second instruction signal Sb are identical to the respective conditions in the ignition unit for an internal combustion engine of the second embodiment as illustrated in FIG. 7. In contrast thereto, changes in the condition of the second instruction signal Sb are opposite to those of the second embodiment as illustrated in FIG. 7 since actions of the thyristor driving circuit 310 differ.

Also in the third embodiment, after energizing the primary current i1 to the primary wiring L1 at timing t1, spark discharge is generated at timing t2, and the thyristor 210 makes short-circuits both ends of the primary wiring L1 at timing t3 upon a change in condition of the second instruction signal Sb whereupon the spark discharge is forcibly interrupted at timing t4.

By performing this series of actions also in the ignition unit for an internal combustion engine of the third embodiment, forcible interruption of spark discharge during one combustion cycle of an internal combustion engine is performed.

As for the ignition controlling process that is performed in the ECU 19 of the third embodiment, processes are performed in accordance with the flowchart that is changed such that the process performed at S170 in the flowchart of the ignition controlling process of the second embodiment as illustrated in FIG. 8 is changed to a process of changing the second instruction signal Sb to low level, and the process of S190 to a process of changing the second instruction signal Sb to high level.

As explained so far, the ignition unit 3 for an internal combustion engine of the third embodiment is capable of forcibly interrupting spark discharge, and thus to exhibit effects similar to those of the second embodiment.

Since only one transistor is required for comprising the thyristor driving circuit 310 of the third embodiment, it can be achieved for an advantage that costs required for the thyristor driving circuit 310 can be reduced in contrast to the second embodiment employing two transistors.

It should be noted that in the third embodiment, current flows through the interruption controlling transistor 47 when the thyristor 210 is not driven, and since the time in which the thyristor 210 is not driven is longer than the time in which the thyristor 21 is driven, the amount of consumed electricity will be large. In contrast thereto, the second embodiment is characterized in that the amount of consumed electricity is small since current is made to flow through the first interruption controlling transistor 41 and the second interruption controlling transistor 43 only when the second instruction signal Sb is of high level, and that this time is short. Thus, when priority should be given to decrease the amount of electricity consumed by the thyristor driving circuit rather than restricting manufacturing costs for the thyristor driving circuit, the thyristor driving circuit 31 of the second embodiment shall be employed.

While the present invention has been explained by way of the above embodiments, the present invention is not limited to the above embodiments but may by variously modified.

For instance, the means for short-circuiting the primary wiring is not limited to a thyristor, and it is alternatively possible to provide a triac to be parallel to the primary wiring such that the primary current is re-energizing by the triac for forcibly interrupting the spark discharge.

The thyristor driving circuit is not limited to the circuit as illustrated in the above embodiments as long as it is a circuit capable of outputting a driving signal, which is of higher potential than the potential of the positive terminal of the power source device, to the gate terminal of the thyristor (triac) in accordance with instruction signals for informing spark discharge durations.

While second instruction signals Sb are output by the ECU in the above embodiments, it is alternatively possible to provide a separate control circuit besides the ECU such that the second instruction signals Sb are output from the control circuit to the thyristor driving circuit. At this time, the control circuit is preferably arranged in that information corresponding to spark discharge duration as calculated by the ECU that comprehensively controls the internal combustion engine are input and second instruction signals Sb are output.

What is claimed is:

1. An ignition unit for an internal combustion engine comprising:

an ignition coil including a primary wiring connected to a power source unit and a secondary wiring forming a closed loop together with a spark plug equipped in the internal combustion engine, a spark discharge generating means for energizing current from the power source unit to the primary wiring of the ignition coil synchronously with the rotation of the internal combustion engine and for generating high voltage for ignition in the secondary wiring by interrupting the energizing current to thereby make the spark plug perform spark discharge, a primary wiring short-circuiting means for short-circuiting both ends of the primary wiring of the ignition coil in the correspondence to instructions from an instruction means, a spark discharge duration calculating means for calculating a spark discharge duration required for combusting mixed gas through spark discharge of the spark plug based on an operating condition of the internal combustion engine, the spark discharge duration being calculated to be long under the low-load and low rotation condition of the internal combustion engine and the same being calculated to be short but equal to or more than 0.2 msec under the high-load and high-rotation condition of the internal engine, and a spark discharge interrupting means for forcibly interrupting spark discharge of the spark plug by short-circuiting both ends of the primary wiring of the ignition coil by actuating the primary wiring short-circuiting means in accordance with the spark discharge duration calculated by the spark discharge duration calculating means.

2. The ignition unit for an internal combustion engine as claimed in claim 1, wherein the primary wiring short-circuiting means is arranged as a switching element permitting energizing only in a direction for consuming the magnetic flux stored in the ignition coil in accordance with instructions from said instruction means for short-circuiting both ends of the primary wiring of the ignition coil, and releasing both ends of the primary wiring thereafter in the absence of current flowing in the permitted direction.

3. The ignition unit for an internal combustion engine as claimed in claim 1, wherein the primary wiring short-circuiting means is a switching element connected to the primary wiring of the ignition coil in a parallel manner with a cathode terminal thereof being connected to a positive terminal of the power source unit, the switching element short-circuiting both ends of the primary wiring upon input of a driving signal, which is of higher potential than the potential of the positive terminal of the power source unit, to a gate terminal thereof, and the ignition unit further comprising:

a driving signal output means for outputting the driving signal, which is of higher potential than the potential of the positive terminal of the power source unit, to the gate terminal of the switching element based on an instruction signal from the instruction means, wherein the switching element is driven to short-circuit both ends of the primary wiring of the ignition coil and to forcibly interrupt spark discharge of the spark plug upon output of the instruction signal from the spark discharge interrupting means to the driving signal output means in accordance with a spark discharge duration that is calculated on a basis of operating conditions of the internal combustion engine and that is required for combusting mixed gas through spark discharge of the spark plug.

4. The ignition unit for an internal combustion engine as claimed in claim 1, wherein the driving signal output means comprises:

a capacitor having a first terminal connected to the gate terminal of the switching element, and a charge/discharge control means connected to a second terminal of the capacitor for controlling charge/discharge of the capacitor, wherein the charge/discharge control means charges the capacitor by setting the potential of the second terminal of the capacitor to a potential of a negative terminal side of the power source unit while the capacitor is discharged such that the potential of the first terminal comes to a higher potential than the potential of the positive terminal of the power source unit on a basis of the instruction signal so as to output a driving signal, which is of higher potential than the potential of the positive terminal of the power source unit, to the gate terminal of the switching element.

5. The ignition unit for an internal combustion engine as claimed in claim 1, further comprising a current restricting means that is serially connected to the capacitor for restricting an amount of discharge current when discharge is performed by the capacitor.

6. The ignition unit for an internal combustion engine as claimed in claim 1, further comprising a noise eliminating means provided between a connecting point of the gate terminal of the switching element and the first terminal of the capacitor and the power source unit for preventing entrance of noise to the gate terminal of the switching element.

7. The ignition unit for an internal combustion engine as claimed in claim 1, wherein the internal combustion engine is a gas engine using a gaseous fuel as fuel.

* * * * *